US005949184A

United States Patent [19]

Ohoshi et al.

[11] Patent Number: 5,949,184

[45] Date of Patent: Sep. 7, 1999

[54] LIGHT-EMITTING DEVICE AND METHOD OF MANUFACTURING THE SAME

[75] Inventors: Toshio Ohoshi, Tokyo; Masanobu Yamamoto, Kanagawa; Tadashi Kiyomiya, Saitama, all of Japan

[73] Assignee: Sony Corporation, Tokyo, Japan

[21] Appl. No.: 08/555,143

[22] Filed: Nov. 8, 1995

[30] Foreign Application Priority Data

Nov. 11, 1994 [JP] Japan ..... 6-303248
Nov. 11, 1994 [JP] Japan ..... 6-303249

[51] Int. Cl.[6] ..... H01J 29/82

[52] U.S. Cl. ..... 313/485; 313/495; 313/496

[58] Field of Search ..... 313/495, 496, 313/466, 336, 351, 309, 292

[56] References Cited

U.S. PATENT DOCUMENTS 5,543,683 8/1996 Haven et al. ..... 313/292

FOREIGN PATENT DOCUMENTS 0 523 702 A1 1/1993 European Pat. Off. .
0 616 354 A2 9/1994 European Pat. Off. .
0 690 467 A1 1/1996 European Pat. Off. .
WO 94/18694 8/1994 WIPO .

*Primary Examiner*—Nimeshkumar D. Patel
*Attorney, Agent, or Firm*—Hill & Simpson

[57] ABSTRACT

A light emitting device having transparent electrodes deposited in stripes on a glass substrate of a fluorescent screen panel, and black mask layers provided in stripes between respective electrodes so as not to overlap the transparent electrodes. Fluorescent materials are respectively formed on the transparent electrodes. Because the black mask layers do not overlap the transparent electrodes, the fluorescent materials have similar pattern to that of the transparent electrodes and do not overlap the black mask layers. Accordingly, the transparent electrodes and fluorescent materials may be finely patterned.

19 Claims, 22 Drawing Sheets

LIGHT-EMITTING DEVICE AND METHOD OF MANUFACTURING THE SAME

BACKGROUND OF THE INVENTION

1. Field of the Invention

The present invention relates to a light-emitting device, for example, a field emission display.

2. Description of the Related Art

An example of field emission displays (FED) comprises a fluorescent screen panel 14 having red, green and blue fluorescent materials R, G and B which are arranged in stripes on a glass substrate 24, and a back panel 16, both of which are placed opposite to each other at a predetermined space therebetween, as shown in an exploded schematic perspective view of FIG. 33. The back panel 16 comprises cathode lines 17 having microchip cathodes 21 serving as field emission cathodes which are formed on a glass substrate 26, and gate electrode lines 19 provided at right angles to the cathode lines 17 through an insulating layer 18, as shown in an enlarged view of FIG. 34.

Both substrates 24 and 26 are placed opposite to each other at a predetermined space of several hundreds $\mu$m, for example, 300 $\mu$m, therebetween. The periphery of an image region is sealed by glass frit sealing so that the inside of the image region is maintained at ultra-high vacuum of $10^{-4}$ to $10^{-7}$ Pa.

In the field emission display having the above-described structure, generally, when a voltage is applied between cathode and gate electrodes to apply an electric field of $10^8$ to $10^9$ V/m to the cathode surface, electron beams are emitted from the tops of the microchip cathodes 21 by the tunnel effect through cathode holes. A potential is successively applied between the cathode and gate electrodes in a matrix structure in correspondence with the emission of the electron beams so that the emitted electron beams are applied to the selected fluorescent stripes R, G or B to make the stripes bright and display an image.

When the space between the cathode side substrate 26 and the fluorescent material side substrate 24 of the field emission display is in a high vacuum, as described above, a high pressure of 1 kg/cm$^2$ is applied to the field emission display at atmospheric pressure. If a vacuum pressure resistance holding structure is not provided between the cathode side substrate 26 and the fluorescent material side substrate 24, the glass plate of each of both substrates 24 and 26 must have a thickness of several tens mm in order to make the field emission display resitant to this pressure.

In order to make the glass plate of each of both substrates 24 and 26 having a thickness of about 1 mm resistant to atmospheric pressure, it is thus necessary to provide a vacuum pressure resistance holding structure between both substrates 24 and 26, specifically, to arrange pillar- or block-formed vacuum pressure resistance holding spacers at intervals of several mm between both substrates 24 and 26.

Such spacers must have the properties that the spacers have high resistance to compressive stress and thus have resistance to atmospheric pressure of about 1 kg/cm$^2$, that a uniform thickness can be maintained over the whole surface of the field emission display, that the spacers have no effect on the loci of electron beams emitted from cathodes, that the spacers less release gases and are stable in a vacuum, and that the spacers can resist to high-temperature treatment in frit sealing and baking.

SUMMARY OF THE INVENTION

The present invention has been achieved in consideration of the above-described situation. An object of the present invention is to provide a light-emitting device and a method of manufacturing the same with high quality and reliability which prevents peeling and collapsing of spacers at atmospheric pressure during the step of producing a fluorescent screen panel or after assembly, and which can be manufactured with high productivity.

Another object of the present invention is to provide a light-emitting device and a method of manufacturing the same which permits the formation of a fine fluorescent material pattern, and which and prevent mask layers (for example, black masks) formed on non-emission portions from adversely affecting the fluorescent materials, thereby securing good light emission with high resolution.

In order to achieve the objects, in accordance with an embodiment of the present invention, a light emitting device comprises a first substrate provided with fluorescent materials, a second substrate, and spacers for holding the first and second substrates opposite to each other at a predetermined space therebetween, wherein each of the spacers comprises a base layer provided on a non-emission portion without the fluorescent material, and a spacer body provided on the base layer.

In accordance with another embodiment of the present invention, a light-emitting device comprises electrodes provided on a substrate, fluorescent materials respectively provided on the electrodes, and mask layers for masking non-emission portions without the fluorescent materials, wherein the mask layers are provided so as not to overlap the electrodes.

Since the light emitting device according to the present invention comprises the spacers each of which comprises the base layer and the spacer body provided on the base layer, it is possible to form the base layer having a larger area than that of the spacer body, or appropriately select a material for both members, thereby forming the strong spacers which neither peel off nor collapse.

In the light-emitting device according to the present invention, since the spacer bodies for holding the vacuum pressure resistant structure are formed by lamination coating of glass paste on the light-emitting side substrate, for example, by screen printing, the height of the spacers and the widths of the spacer bodies and the base layers can be independently determined. It is thus possible to decrease the pitch of the spacer bodies in accordance with the pitch of the under black masks, i.e., the pixel pitch, while determining the height of the spacers in accordance with the space between the first and second substrates. When the light emitting device has pixels arranged with a fine pitch, therefore, an attempt can be made to improve the contrast ratio and image quality.

Since the spacer bodies are formed by lamination coating, for example, by the screen printing method, the spacer bodies can be formed in a desired shape with high productivity. Namely, it is possible to form the spacer bodies having a desired height by changing the number of times of coating, and form the spacers with a uniform height. It is also possible to form the spacer bodies in a narrow pattern with a width of about 50 $\mu$m.

In addition, since a frit material used for bonding CRT (Cathode Ray Tube) can be used as the glass paste for screen printing, the spacers formed by the screen printing release less gases, are stable in a vacuum, and are resistant to high-temperature treatment in frit sealing and baking. It is also possible to add various additives for adding functions to the glass paste.

Further, since the spacers can be formed on the first substrate, for example, by screen printing, the second substrate (e.g., the cathode side substrate) is not contaminated during the formation of the spacers, thereby causing no adverse effect on the field emission process.

DETAILED DESCRIPTION OF THE PREFERRED EMBODIMENTS

The applicant of this invention possesses the other pending applications of Ser. Nos. 277,576 and 290,102, which relate to FED.

Figure 28:
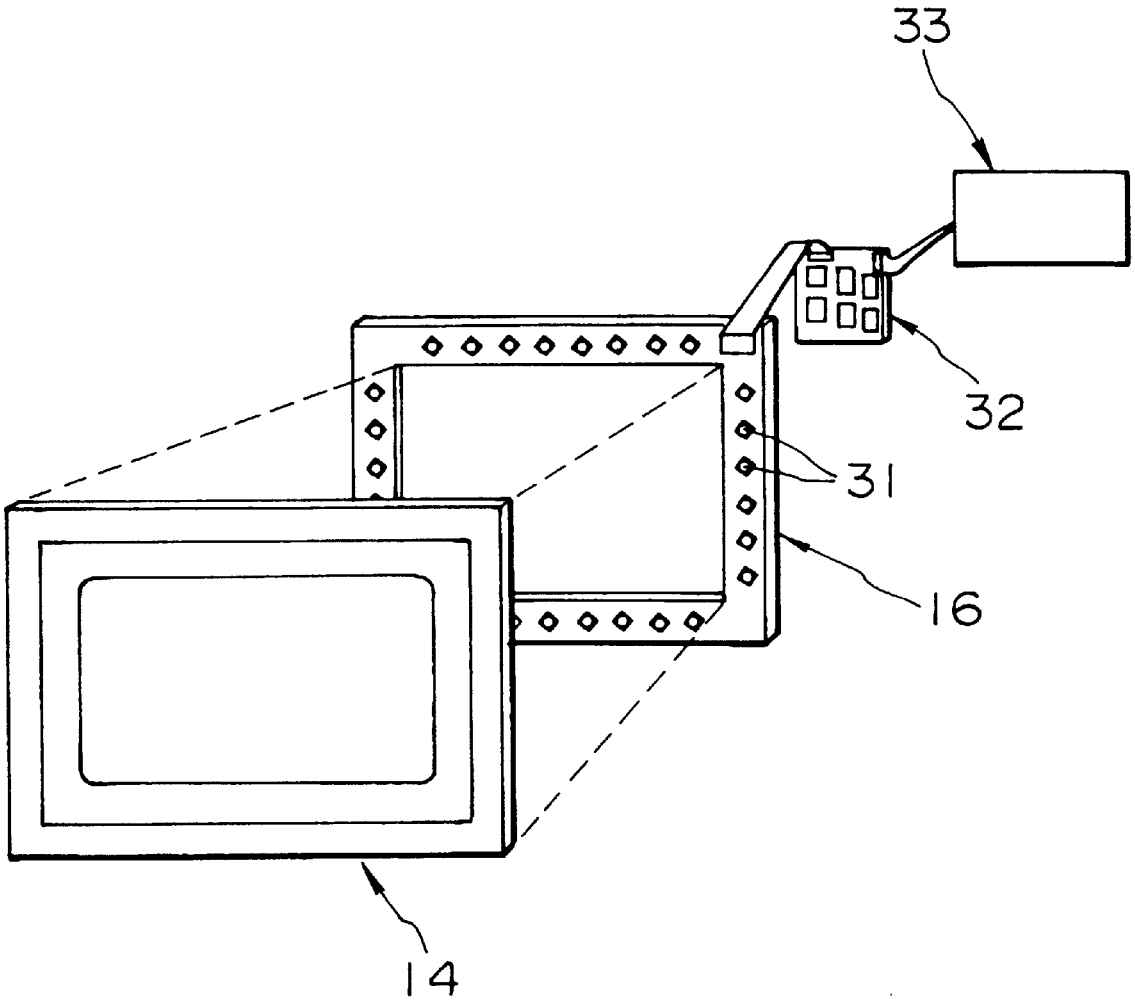
FIG. 28 is an exploded perspective view of FED as viewed from the front side.
Figure 29:
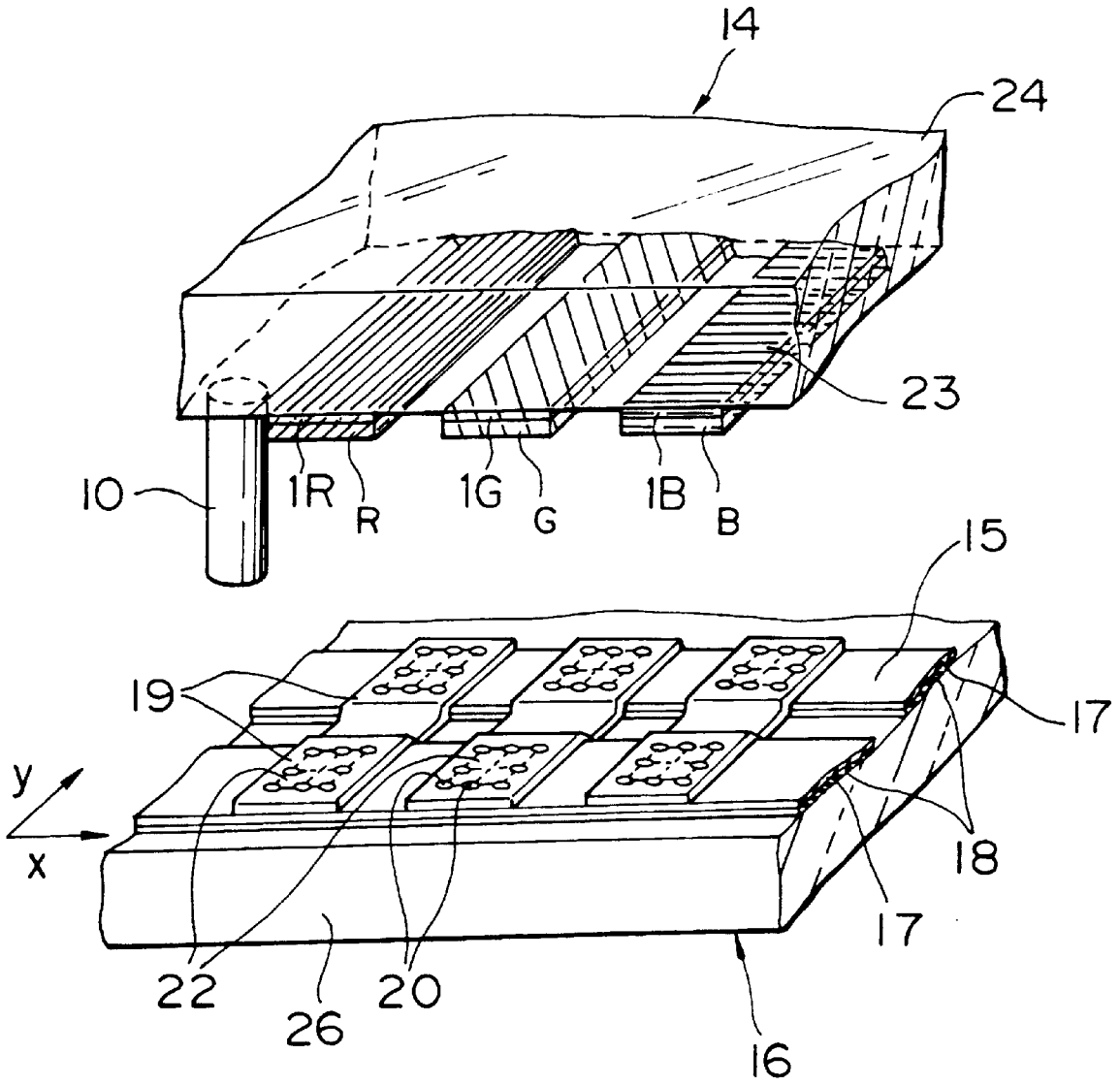
FIG. 29 is an enlarged perspective view of FED as viewed from the side.
Figure 30:
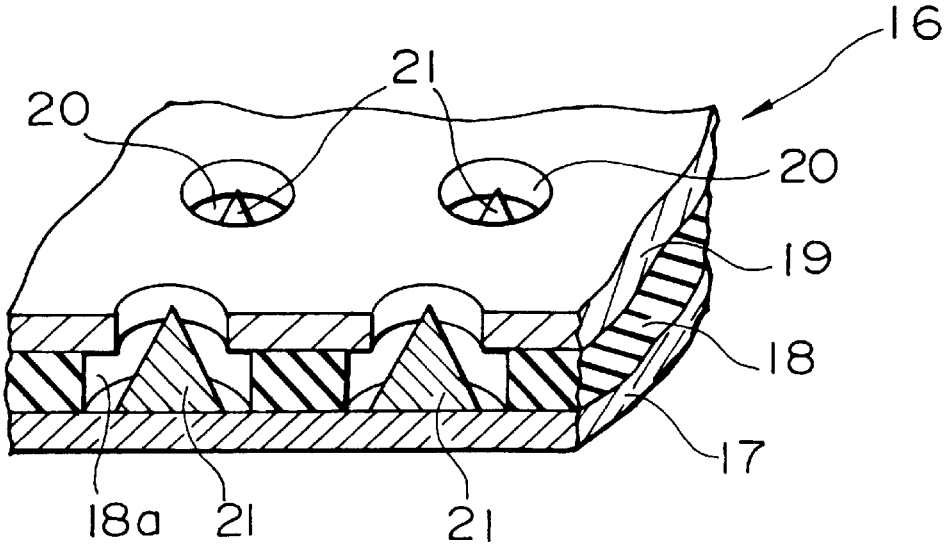
FIG. 30 is an enlarged schematic perspective view showing a principal portion of a back panel of FED.

An example of field emission displays (FED) comprises a fluorescent screen panel 14 having red, green and blue fluorescent material stripes R, G and B which are formed on a glass substrate 24, and a back panel 16, both of which are placed opposite to each other at a predetermined space therebetween, as shown in exploded schematic perspective views of FIGS. 28 and 29. The back panel 16 has an electrode structure 15 comprising cathode lines 17 each having conical microchip cathodes (emitter cones) 21 serving as field emission cathodes which are formed on a glass substrate 26, and gate electrode lines 19 which are arranged at right angles to the cathode lines 17 through an insulating layer 18, as shown in an enlarged view of FIG. 30. In FIG. 28, reference numeral 31 denotes electrode driving IC chips, reference numeral 32, an interface board; and reference numeral 33, a host computer.

Both substrates 24 and 26 are placed opposite to each other at a predetermined space of several hundreds $\mu$m, e.g., 300 $\mu$m, therebetween, and the periphery of an image region is sealed by glass frit sealing (not shown) so that the inside of the image region is maintained at an ultra-high vacuum of $10^{-4}$ to $10^{-7}$ Pa.

In the field emission display (referred to as "FED" hereinafter) having the above structure, generally, when a voltage is applied between the cathode and gate electrodes so as to apply an electric field of $10^8$ to $10^9$ V/m to the cathode surface, electron beams are emitted from the tops of the microchip cathodes 21 by the tunnel effect through cathode holes 20 at the intersections 22 between both electrodes. A potential is successively applied between the cathode and gate electrodes in a matrix structure in correspondence with the emission of electron beams so that the emitted electron beams are applied to the selected fluorescent material stripes R, G or B, to make the stripes bright and display an image.

Color display methods using the FED include a method of causing each of the cathodes at the selected intersections 22 to correspond to a fluorescent material of one color, and a so-called color selection method of causing each of the cathodes to correspond to the fluorescent materials of a plurality of colors. The color selection operation is described with reference to FIGS. 31 and 32.

Figure 31:
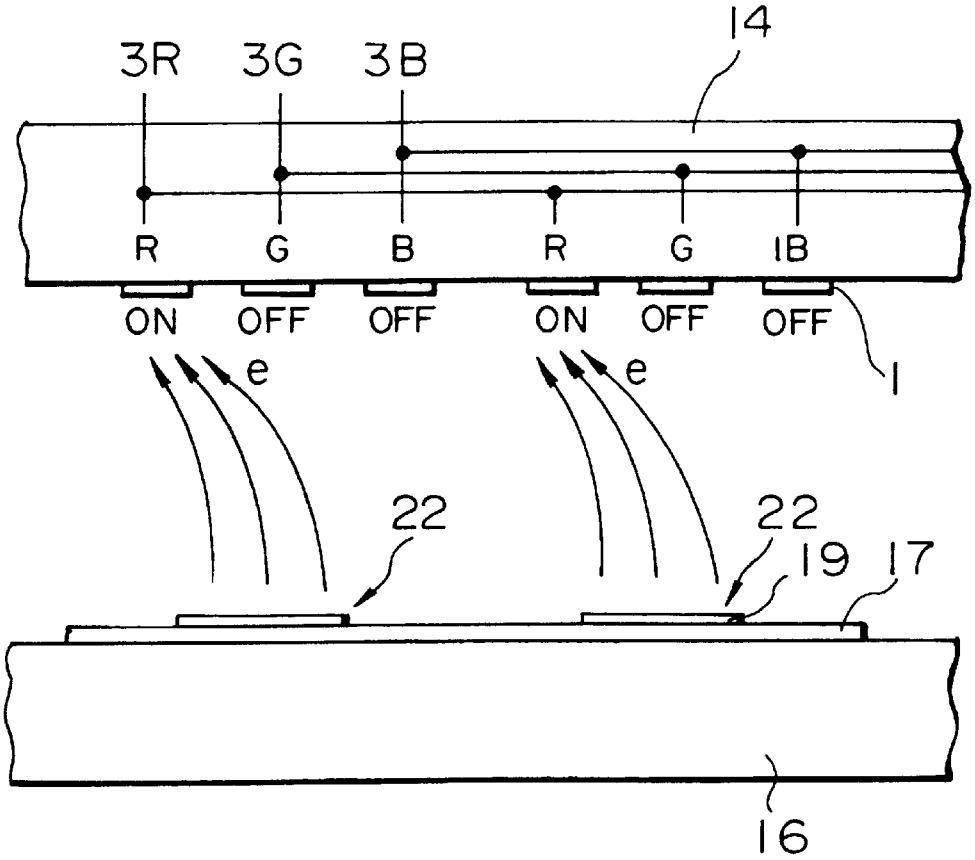
FIG. 31 is a drawing illustrating selection of a color by switching three terminals R, G and B of FED.

Referring to FIG. 31, the fluorescent materials R, G and B corresponding to respective colors are successively formed on a plurality of stripe-shaped transparent electrodes on the inner side of the fluorescent screen panel 14, the electrodes of respective colors being collected and led out through green and blue terminals 3R, 3G and 3B.

On the opposite back panel 16 are provided the cathode electrodes 17 and the gate electrodes 19 in stripes at right angles, as described above. When an electric field of $10^8$ to $10^9$ V/m is applied between the cathode electrodes 17 and the gate electrodes 19, electrons e are emitted from the emitter cones 21 at the intersections 22 between both electrodes.

On the other hand, when a voltage of 100 to 1000 V is applied between the transparent electrodes 1R, 1G and 1B (i.e, anode electrodes) and the cathode electrodes 17, the emitted electrons are accelerated to emit light from the fluorescent materials. FIG. 31 shows a case where a voltage is applied to only the red fluorescent materials R to accelerate electrons a, as shown by arrows.

Figure 32:
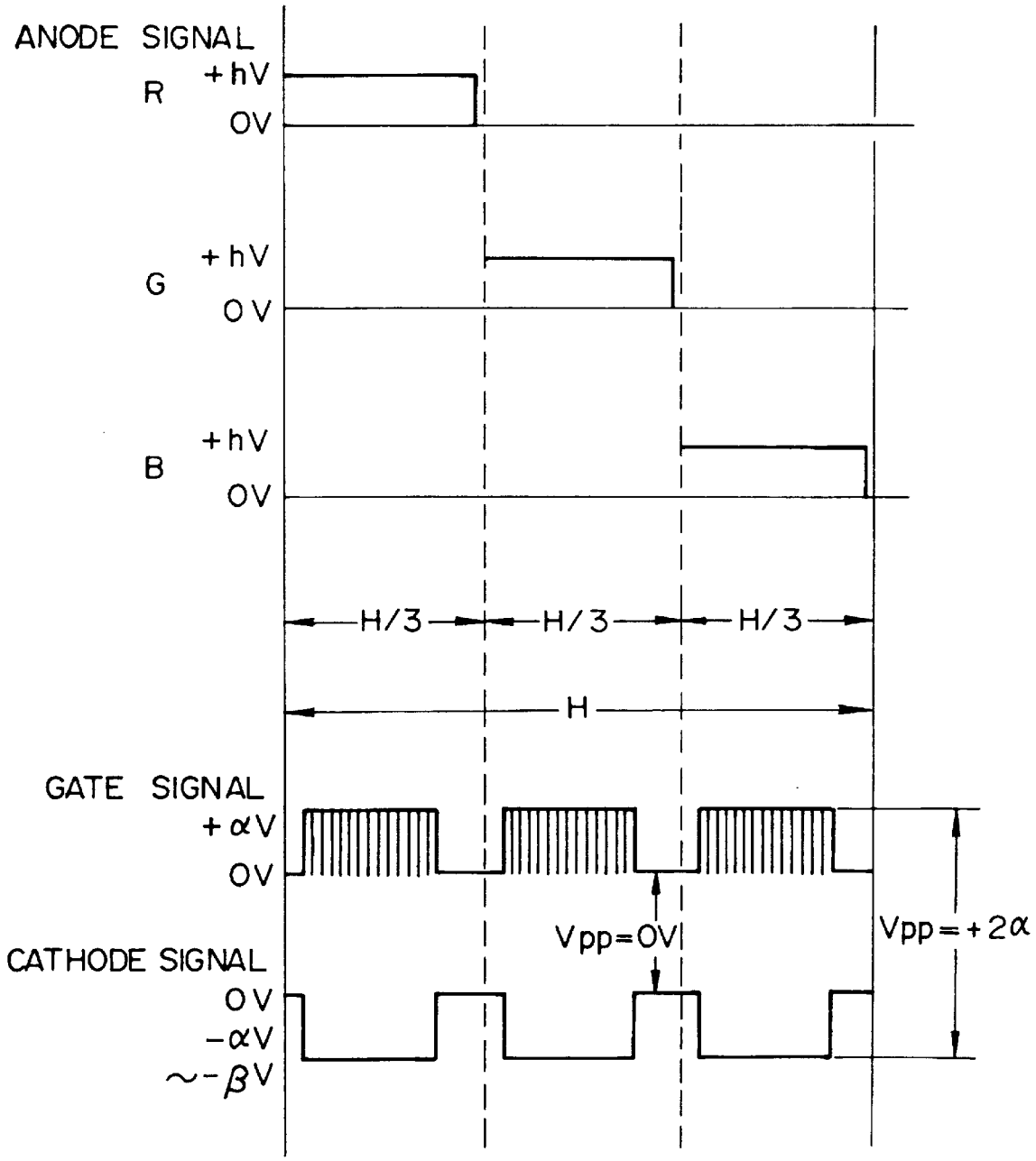
FIG. 32 is a drawing showing a timing chart for color selection.

In this way, time-series selection of the three terminals for colors R, G and B enables color display. FIG. 32 is a timing chart for NTSC system color selection using the cathode, gate and anode (fluorescent material stripe) at a point on each of the cathode electrode lines.

When the cathode electrode lines 17 are successively driven with a period of 1 H, a signal of +hV is applied to each of the fluorescent materials R, G and B with a period of H/3. On the other hand, a gate signal $+\alpha V$ and cathode signal $-\alpha V$ to $-\beta V$ are synchronously applied to each of the fluorescent materials R, G and B with a period of H/3. When the gate-cathode voltage $V_{pp}=+2\alpha V$, electrons are emitted to make bright the fluorescent materials R, G and B which are selected with a period of H/3, thereby permitting color selection. This enables full color display.

Embodiments of the present invention will be described.

Figure 1:
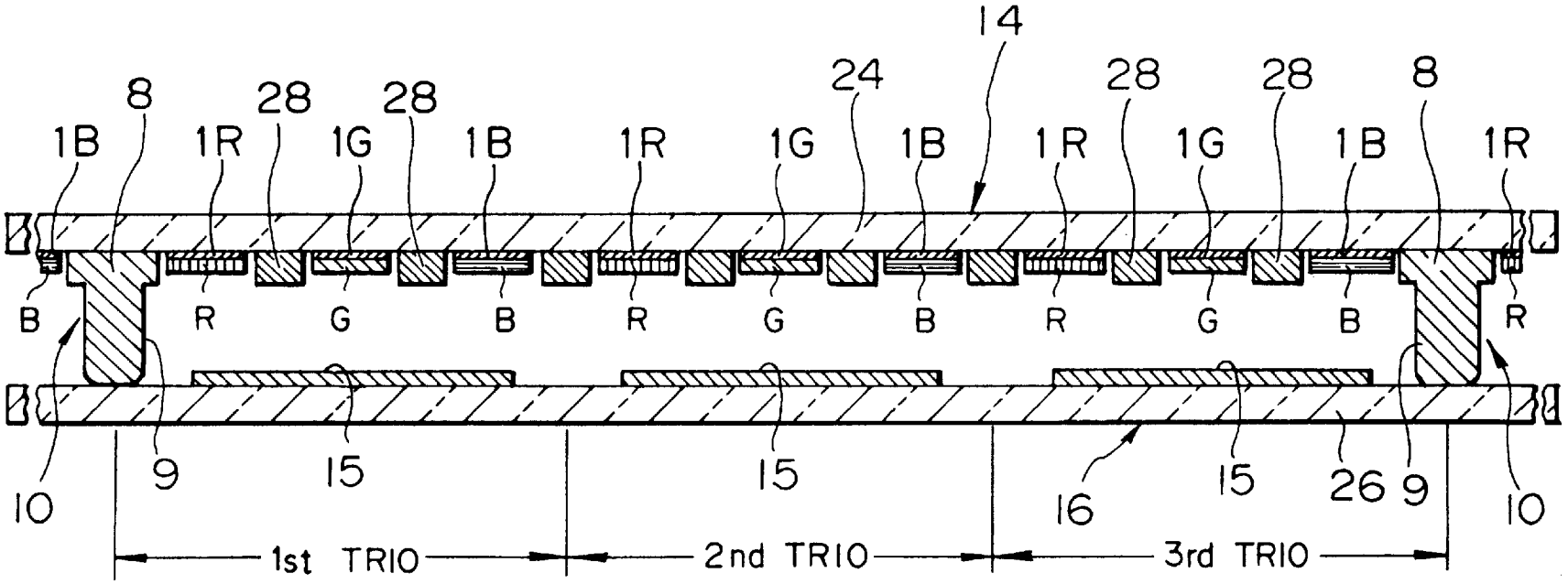
FIG. 1 is an enlarged sectional view of a principal portion of a field emission display (FED) in accordance with an embodiment of the invention.

FIG. 1 is an enlarged sectional view of a principal portion of FED in accordance with an embodiment of the present invention. Black mask layers 28 are provided between respective fluorescent elements R, G and B and respective transparent electrodes 1R, 1G and 1B. Wide black mask layers 8 are provided at intervals of 3 TRIOs each comprising red, green and blue colors, and a spacer body 9 is provided on each of the black mask layers 8. Each of spacers 10 comprises the black mask layer 8 and the spacer body 9.

Each of the black mask layers 8 has a width (an area) larger than that of the spacer body 9 so as to make the spacer 10 stable. The fluorescent screen panel 14 and the back panel 16 provided with the electrode structure 15 are maintained at a predetermined space therebetween by the spacers 10. Since non-emission portions (particularly, regions between the respective fluorescent elements) are respectively coated with the black mask layers 8 and 28, a good color display with improved contrast can be attained.

Figure 2:
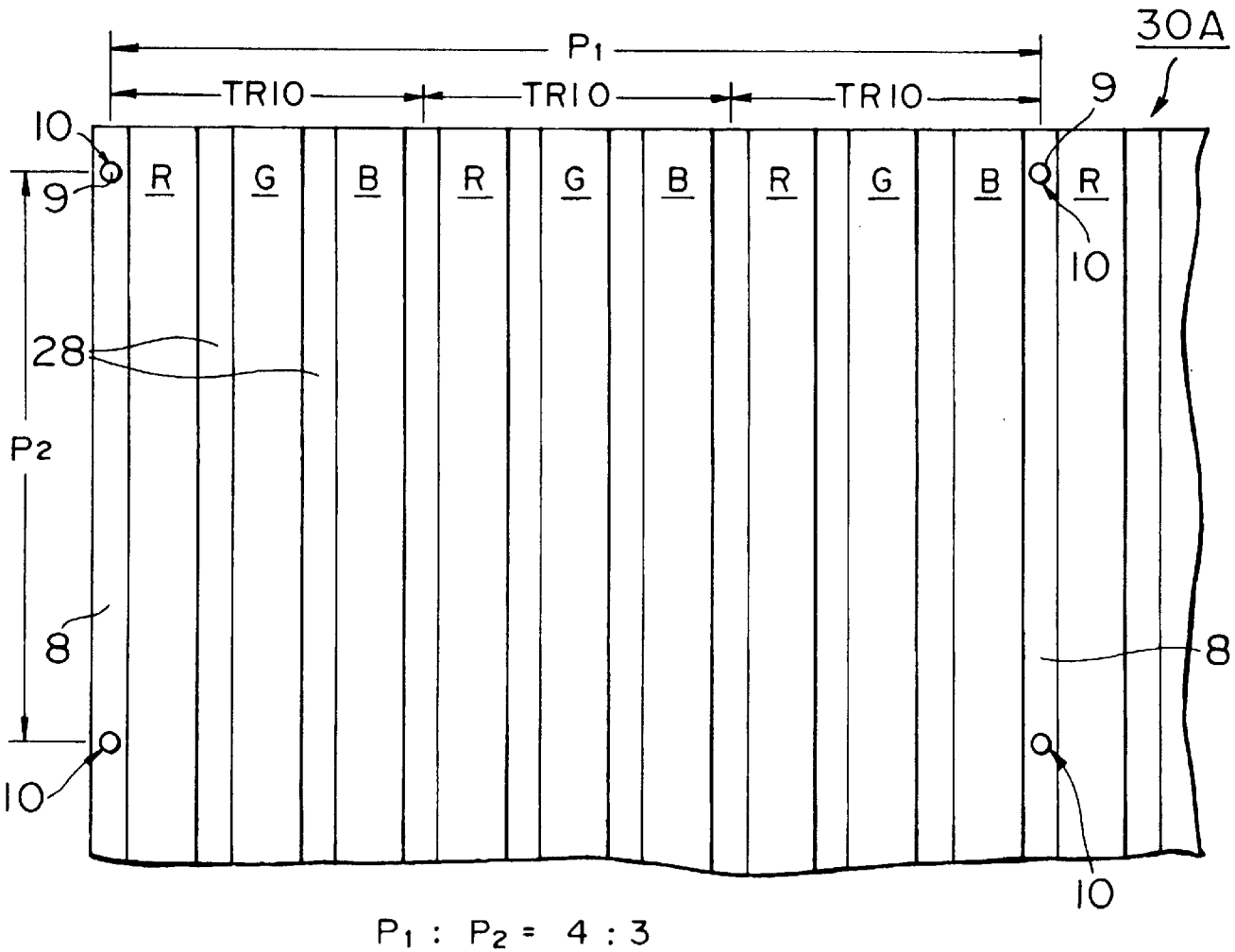
FIG. 2 is an enlarged partial front view of an image display portion of the same display, as viewed from the side of a back panel thereof.

FIG. 2 is an enlarged partial front view of an image display portion (a region with the fluorescent materials) 30A of the fluorescent screen panel 14, as viewed from the side of the back panel.

The black mask layers 8 are provided in stripes between blue and red colors at intervals of 3 TRIOs each comprising red, green and blue colors, the spacer bodies 9 being respectively erectly provided on the black masks 8. In this case, the pitch of TRIOs is 0.4 mm, and the spacers 10 are thus provided with a pitch of 1.2 mm shown by $P_1$ at intervals of 3 TRIOs. In the FED, the ratio of the entire length in the direction of pitch $P_1$ to the entire length in the direction of the stripes perpendicular to the direction of pitch $P_1$ is generally 4:3, and the pitch $P_2$ of the spacer bodies 9 respectively provided on the black mask layers 8 is thus, for example, 0.9 mm. On the image display portion 30A are provided the spacers 10 in directions crossing at right angles, for example, with a pitch of 1.2 mm and a pitch of 0.9 mm, respectively.

Figure 3:
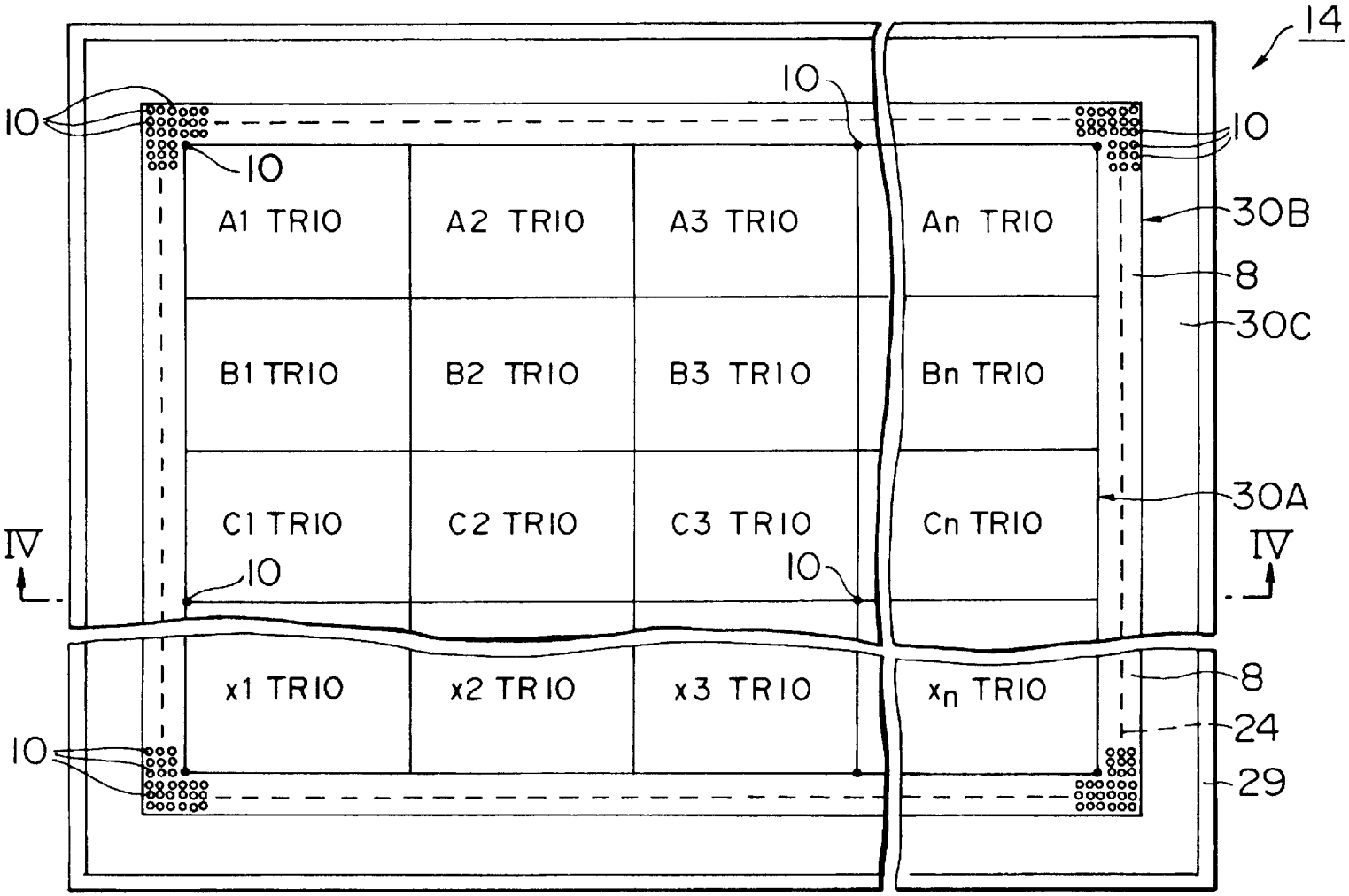
FIG. 3 is an enlarged partial front view of a fluorescent screen panel of the same display, as viewed from the side of the back panel thereof.
Figure 4:
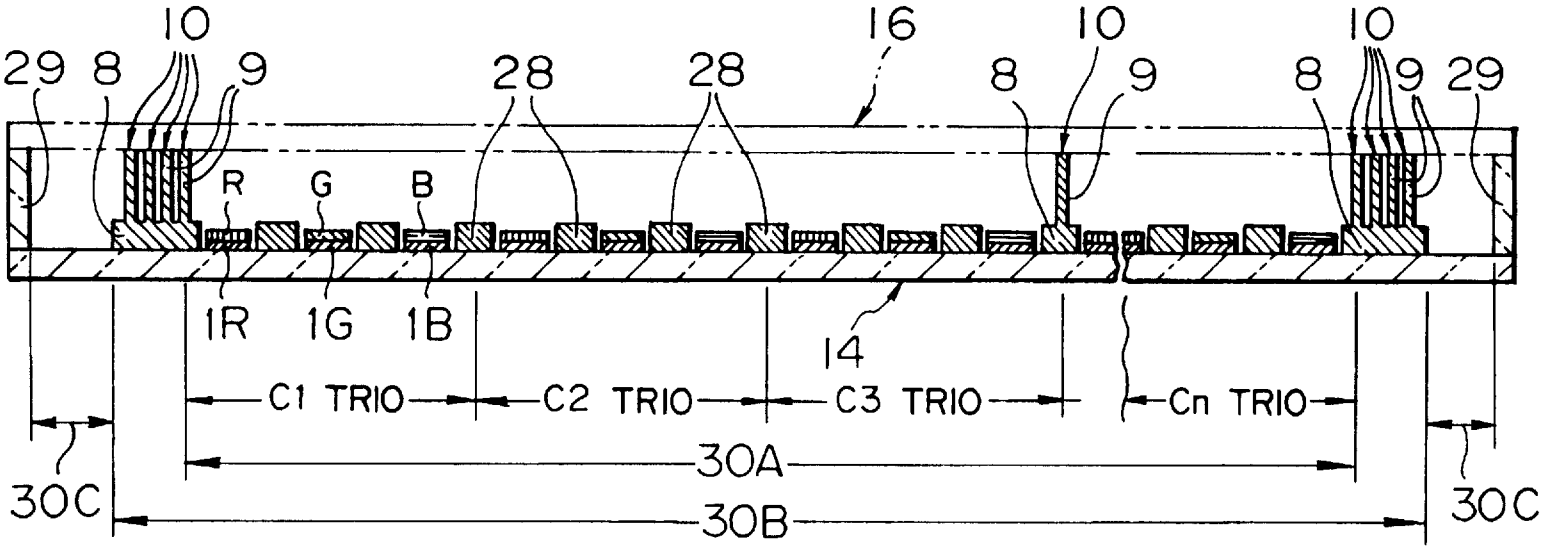
FIG. 4 is a sectional view taken along line IV—IV of FIG. 3.

FIG. 3 is an enlarged front view of the fluorescent screen panel 14, as viewed from the side of the back panel, and FIG. 4 is a sectional view taken along line IV—IV of FIG. 3. The TRIOs are arranged in n lines and x columns, A1TRIO to AnTRIO respectively indicating TRIO regions in line A, B1TRIO to BnTRIO respectively indicating TRIO regions in line B, and x1TRIO to xnTRIO respectively indicating TRIO regions in line x.

A sealing glass wall 29 is erectly provided by bonding over the whole edge of the substrate 24 of the fluorescent screen panel 14 so as to maintain a high vacuum in the space between the fluorescent screen panel 14 and the back panel 16, the black mask layers 8 being provided in a region at a distance from the glass wall 29 between the image display portion 30 and the glass wall 29. In this region of the black mask layers 8, the spacer bodies 9 (refer to FIG. 1) are erectly provided to form the spacers 10. In this region, the spacers 10 are provided in 3 lines in the direction perpendicular to the florescent material stripes and in 4 lines in the direction parallel to the fluorescent material stripes.

A region comprising the region of the black mask layer 8 where the spacers 10 are provided, and the inside image display portion 30A is referred to as the entire display portion (denoted by reference numeral 30B). Electrode driving IC chips (denoted by reference numeral 31 in FIG. 28) are provided opposite to the region 30C between the entire display portion 30B and the glass wall 29.

FIGS. 3 and 4 indicate that many spacers 10 are provided in a region of the entire display portion 30B other than the image display portion 30A, and the spacers 10 are further provided in the image display portion 30A with predetermined pitches (in this embodiment, pitches of 1.2 mm and 0.9 mm), and thus both substrates 24 and 26 can resist atmospheric pressure and maintain a constant space therebetween even if the space between the fluorescent screen panel 14 and the back panel 16 shown by virtual lines in FIG. 4 is brought into a high vacuum. In FIG. 3, the dimensions of the entire display portion 30B are 8 inches long and 6 inches wide.

In this embodiment, attention must be given to the point that the black mask layers 8 and 28 are provided between the respective transparent electrodes 1R, 1G and 1B so as not to overlap the transparent electrodes 1R, 1G and 1B. The black mask layers 8 and 28 are formed by printing (for example, screen printing) using the resist masks which are formed to respectively cover the transparent electrodes by photolithography.

The black mask layers 8 and 28 can thus be formed in a pattern with high precision. Coating or printing using the resist masks can prevent the black mask layers 8 and 28 from overlapping the edges of the transparent electrodes 1R, 1G and 1B because the sides of the black mask layers are substantially vertical to the main surface of the substrate 24. Therefore, the fluorescent materials R, G and B respectively formed on the transparent electrodes 1R, 1G and 1B (formed by electrodeposition) do not overlap the black mask layers 8 and 28. This will be described below with reference to FIGS. 5 to 12.

Figure 33:
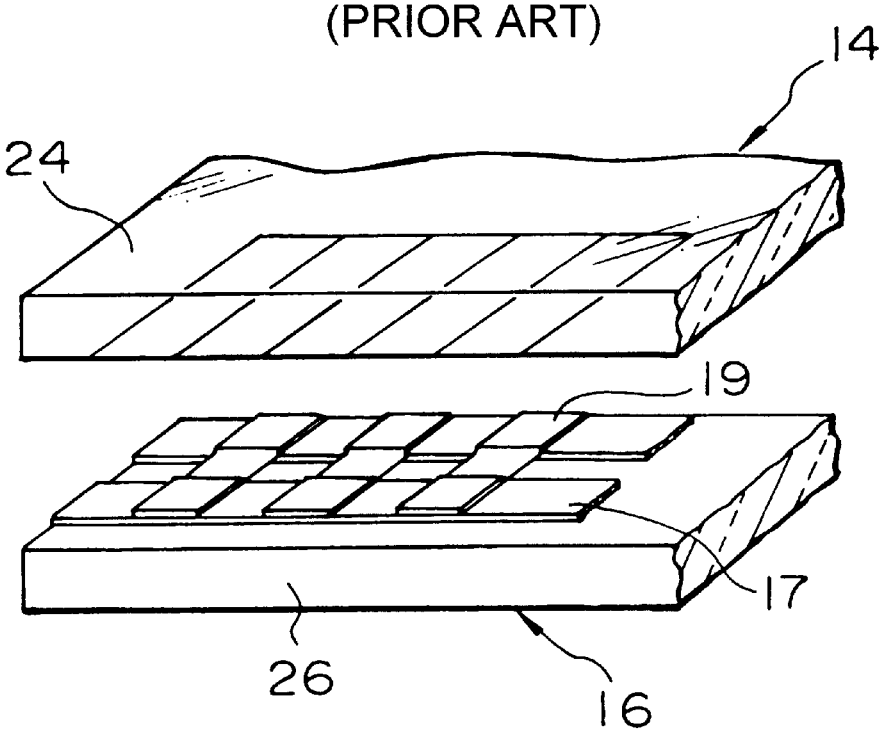
FIG. 33 (PRIOR ART)
FIG. 33 is an exploded schematic perspective view of a conventional example of FED.
Figure 34:
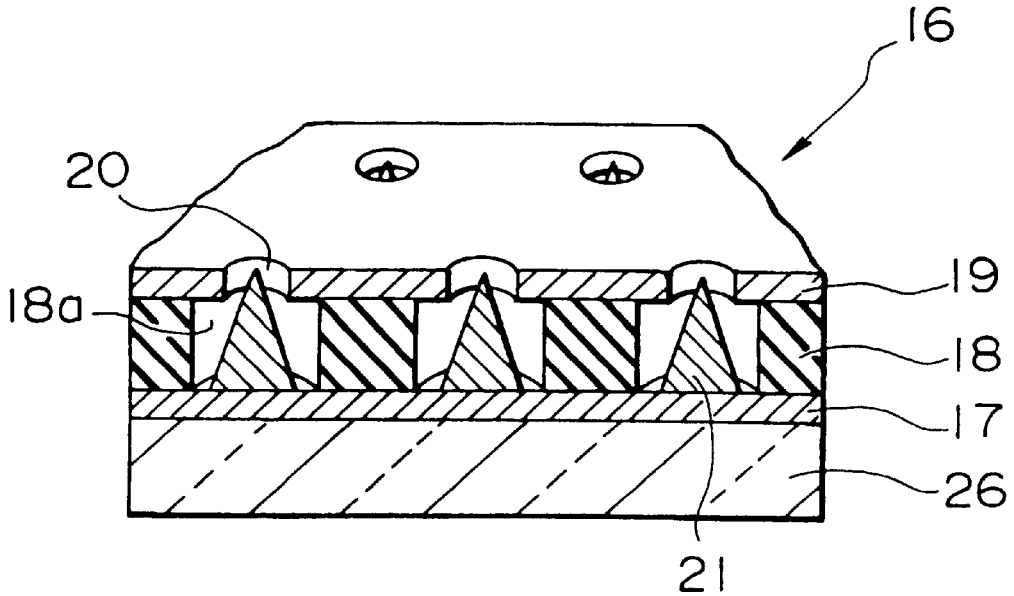
FIG. 34 (PRIOR ART)
FIG. 34 is an enlarged perspective view of a back panel of a conventional example of FED.

Since the fluorescent materials R, G and B do not overlap the black mask layers 8 and 28, there is no possibility that the fluorescent materials are peeled, as described above, thereby stably achieving good emission. In addition, since the fluorescent materials R, G and B are respectively formed on the transparent electrodes (respectively denoted by reference numerals 1R, 1G and 1B in correspondence with the colors of the fluorescent material elements formed thereon) with the same width, each of the transparent electrodes need not be formed with a large width, as shown in FIG. 33. It is thus possible to decrease the pitch of the transparent electrodes and the fluorescent materials, and achieve emission with high resolution.

The procedure for producing the fluorescent screen panel will be described.

Figure 5:
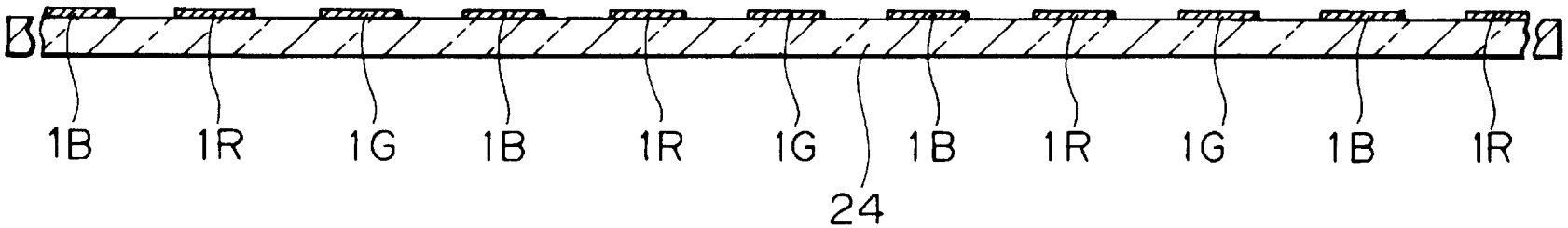
FIG. 5 is an enlarged partial sectional view of a substrate showing a first step for producing the fluorescent screen panel.

The transparent electrodes IR, IG and 1B consisting of ITO (Indium Tin Oxide: a mixed oxide of indium and tin) are first formed in stripes on the substrate 24 by conventional photolithographic technology, as shown in FIG. 5. FIG. 5 shows a state where the resist masks used for forming the transparent electrodes are removed.

Figure 6:
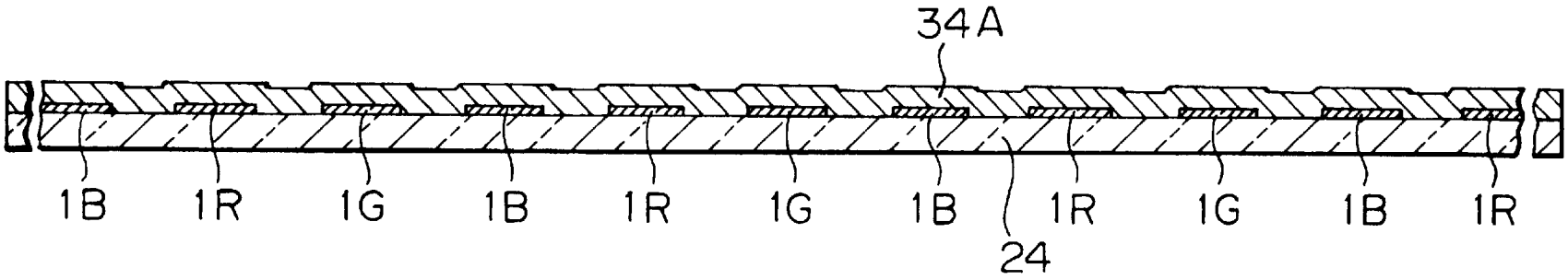
FIG. 6 is an enlarged partial sectional view of the substrate showing a second step for producing the fluorescent screen panel.
Figure 7:
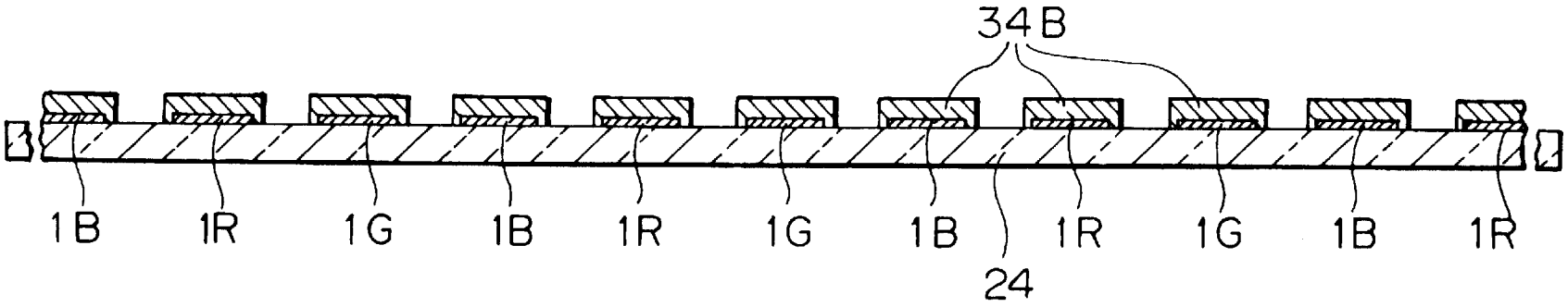
FIG. 7 is an enlarged partial sectional view of the substrate showing a third step for producing the fluorescent screen panel.

A sheet-formed photosensitive resist 34A having a thickness of several tens $\mu$m is then bonded to the entire surface of the substrate 24 by using a laminator or the like, as shown in FIG. 6. Ultraviolet exposure and alkali development are then performed to form negative resist masks 34B slightly wider than the transparent electrodes 1R, 1G and 1B so as to cover the outside of the entire display portion 30B and the transparent electrodes 1R, 1G and 1B, as shown in FIG. 7.

Figure 8:
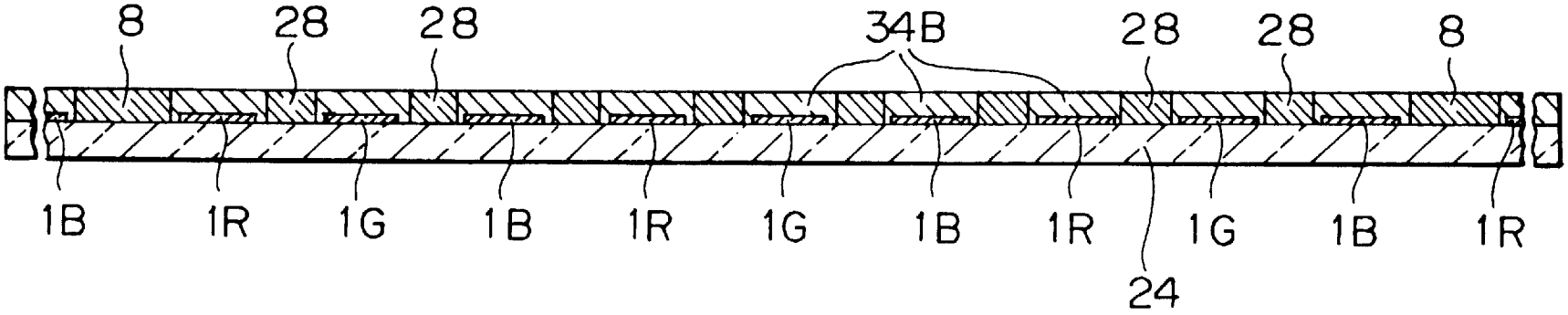
FIG. 8 is an enlarged partial sectional view of the substrate showing a fourth step for producing the fluorescent screen panel.

A black mask material (black glass paste) is then coated or filled in the portions from which the resist 34A is removed by development, using the resist masks 34B as masks, as shown in FIG. 8, followed by drying, for example, at a temperature of about 150° C. to form the black mask layers 8 and 28 between the respective transparent electrodes 1R, 1G and 1B. This coating or filling can be performed by a doctor blade method or a screen printing method.

Dry film resist (for example, A-840 produced by Fuji Hant Electronics Technology Co., Ltd.) can be used as the sheet-formed photosensitive resist 34A. Such resist can be removed by lift-off using an alkali solution or combustion at the burning temperature in burning of the glass paste.

Frit materials such as $B_2O_3$—PbO—ZnO, $B_2O_3$—PbO—$SiO_2$, and the like, which are dispersed in binders such as ethyl cellulose, can be used as the glass paste. Such a glass paste is preferable because when it is dried or semidried at a temperature of about 150° C. after coating and is then burnt at a temperature of about 500 to 600° C., the organic substance is completely decomposed and becomes an inorganic substance to form a stable substance which releases less gases in a vacuum. This embodiment uses black glass paste (G3-0428: produced by Okuno Seiyaku Co., Ltd.).

Figure 9:
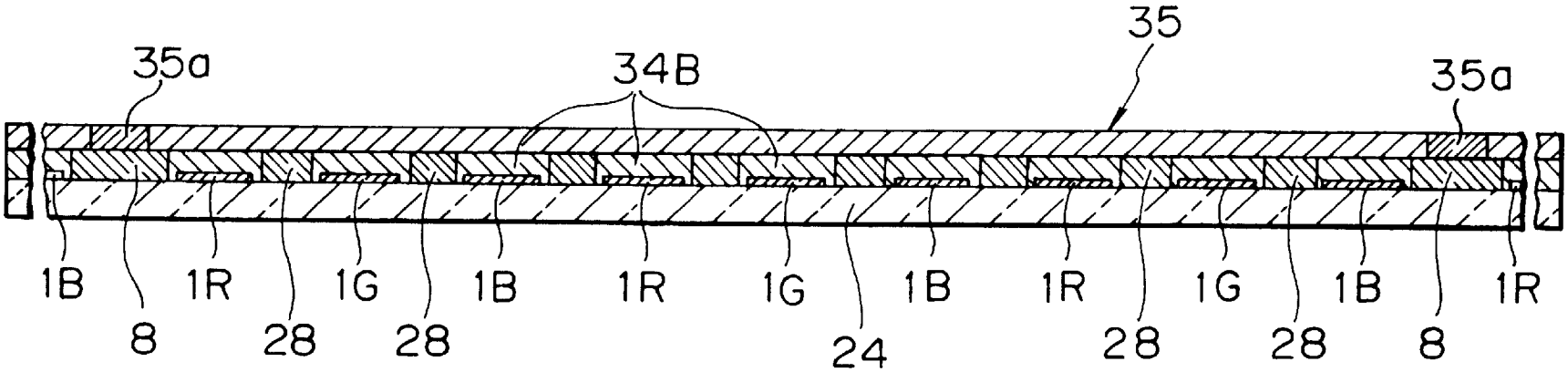
FIG. 9 is an enlarged partial sectional view of the substrate showing a fifth step for producing the fluorescent screen panel.

The resist masks 34B are then replaced by another printing mask 35. The mask 35 is positioned as shown in FIG. 9, and portions of the spacer bodies 9 are then formed by screen printing using the same glass paste as described above, as shown in FIG. 10. In this step, drying is carried out for each screen printing. This operation is repeated to form the spacer bodies 9 each having a predetermined thickness. The spacer bodies having a predetermined thickness can be easily and correctly formed by repeating screen printing and drying because a coated layer having a thickness of several $\mu$m to several tens $\mu$m can be formed by one time of screen printing. Since the spacers are formed by screen printing, the back panel side is not contaminated during the formation of the spacers, thereby exerting no adverse effect on the field emission process.

Figure 10:
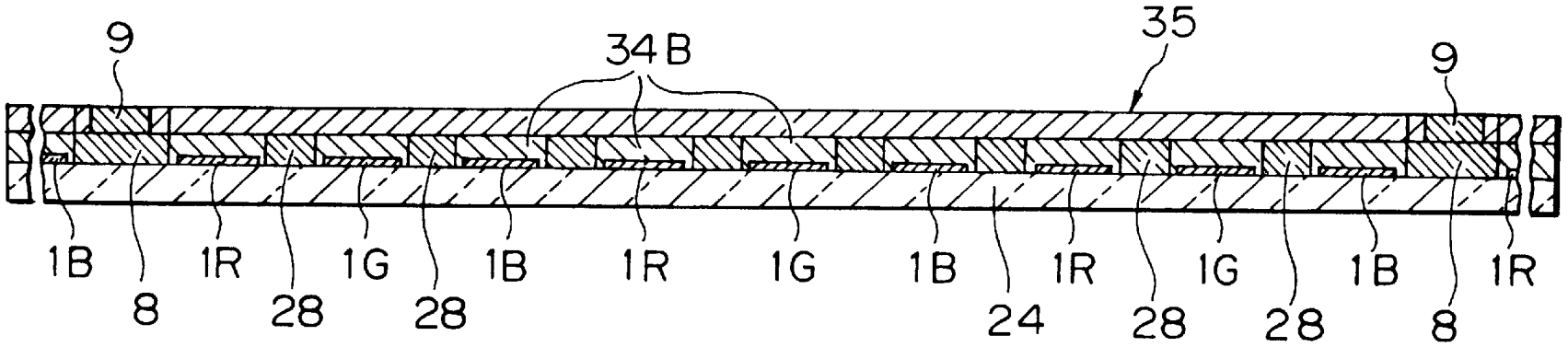
FIG. 10 is an enlarged partial sectional view of the substrate showing a sixth step for producing the fluorescent screen panel.

A mesh screen made of a metal such as stainless steel or the like can be used as a screen plate, and a glass plate can generally be used as the fluorescent material side substrate 24. In FIGS. 9 and 10, reference numeral 35*a* denotes a printed portion with a coarse mesh.

Figure 11:
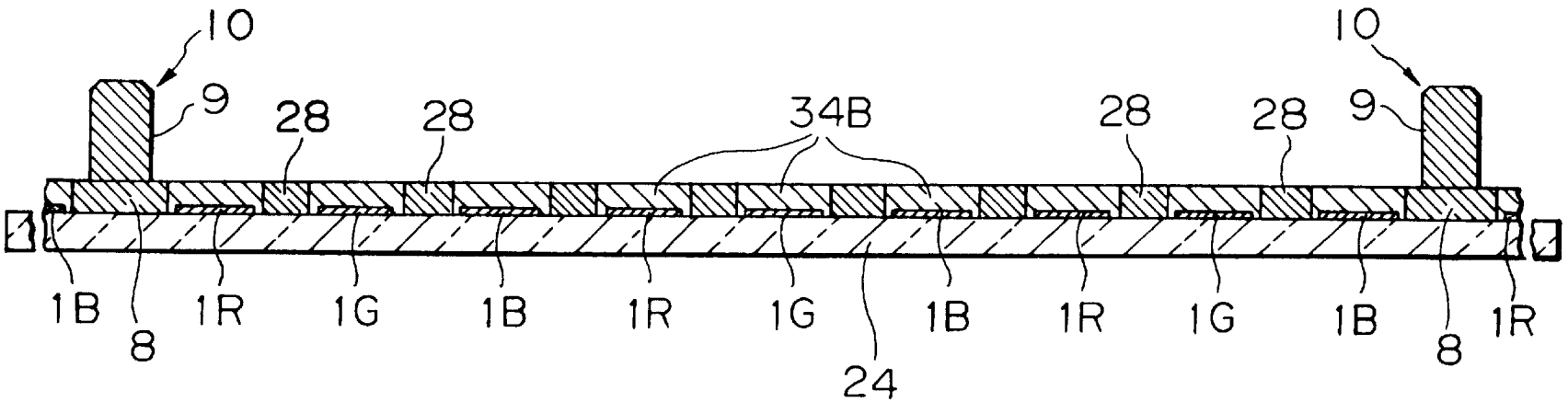
FIG. 11 is an enlarged partial sectional view of the substrate showing a seventh step for producing the fluorescent screen panel.
Figure 12:
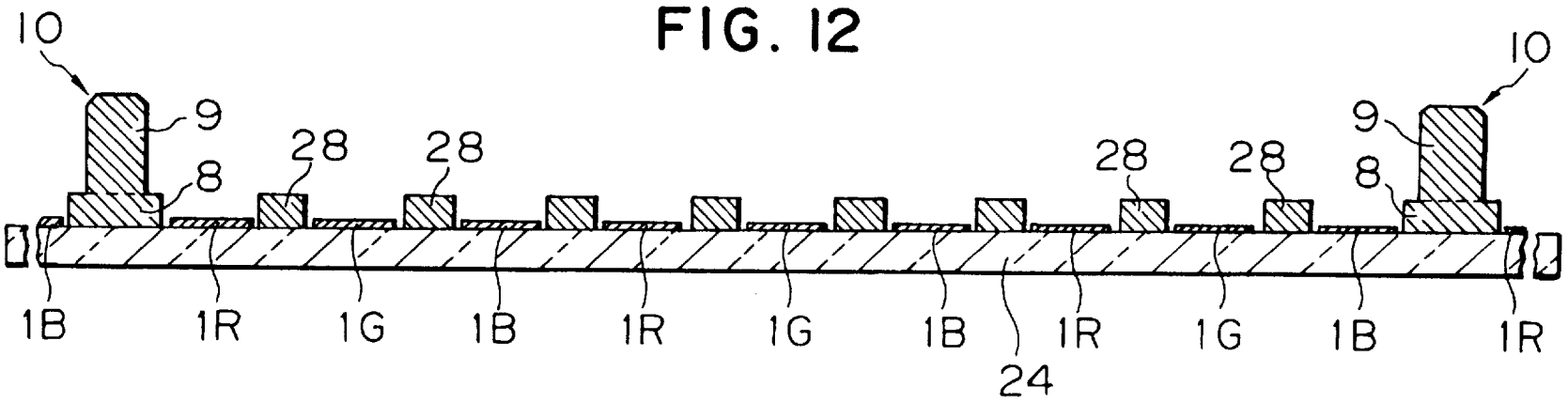
FIG. 12 is an enlarged partial sectional view of the substrate showing an eighth step for producing the fluorescent screen panel.

After the spacer bodies 9 are formed by repeating the screen printing, as shown in FIG. 11, the resist masks 34B are removed by resolution. FIG. 12 shows the state without the resist masks 34B.

The substrate 24 is then burnt at 580° C. to solidify the black mask layers 28, and integrally solidify the black mask layers 8 and the spacer bodies 9 to form the spacers 10. Since the spacer bodies 9 are respectively formed on the black mask layers 8 which are wider than the spacer bodies 9, the spacers 10 are stable, thereby preventing damages such as peeling and breaking during printing, subsequent printing of the fluorescent materials, assembly of FED or use of FED. Even if the resist masks 34B are not removed before burning, the resist masks 34B can be removed by combustion during burning.

Although, in the method according to the present invention, the spacers are formed on the substrate 24 by the screen printing method as described above. it is most suitable to form the spacers by the screen printing before the fluorescent materials are formed in stripes on the substrate 24.

The method of respectively forming the fluorescent material elements (films) on the transparent electrodes by electrodeposition will be described with reference to FIGS. 13 to 15.

Figure 13:
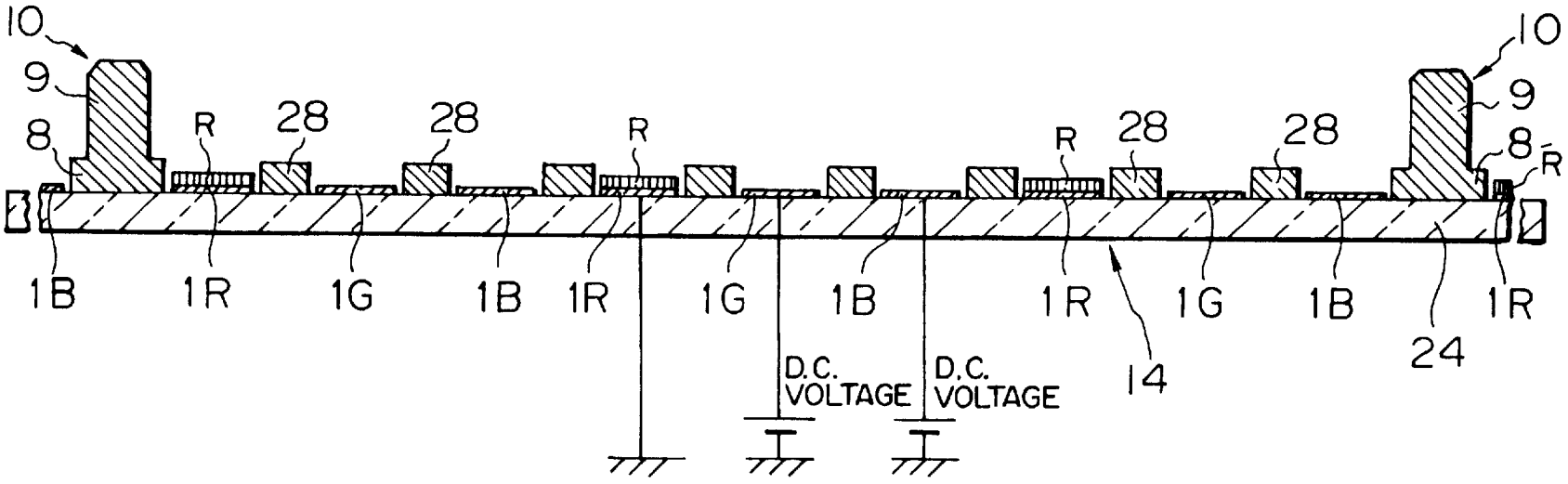
FIG. 13 is an enlarged partial sectional view of the substrate showing a ninth step for producing the fluorescent screen panel.
Figure 14:
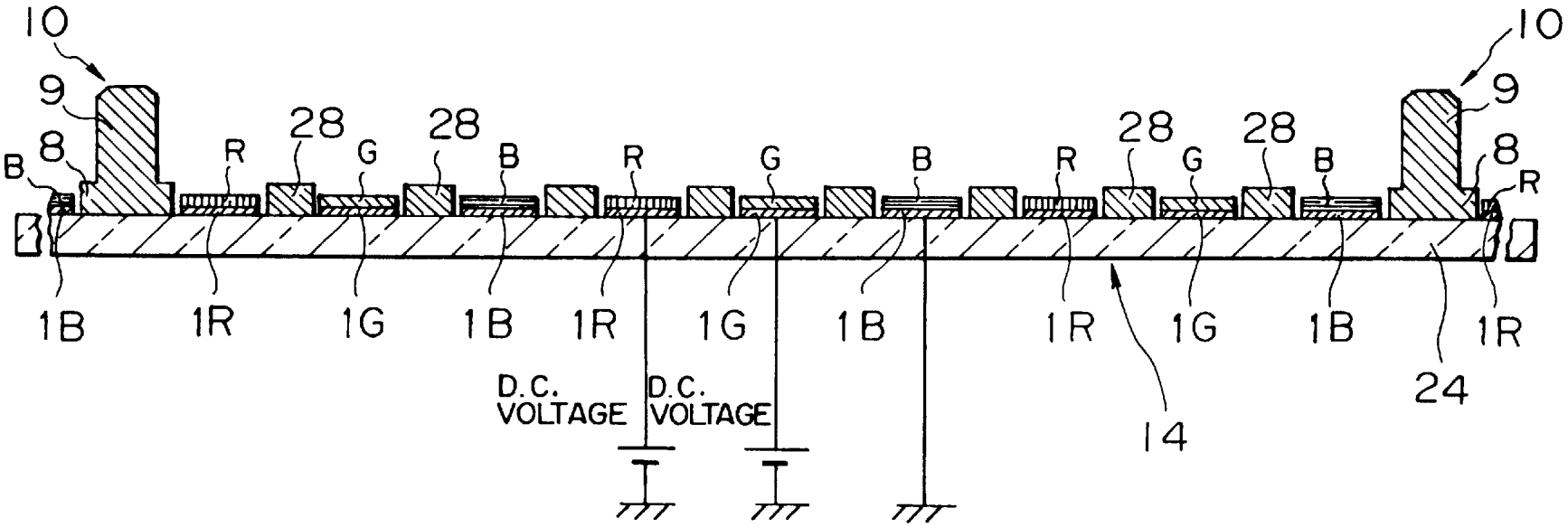
FIG. 14 is an enlarged partial sectional view of the substrate showing a tenth step for producing the fluorescent screen panel.

The fluorescent material films are successively deposited on the transparent electrodes, color by color, as shown in FIGS. 13 and 14. For example, the red fluorescent material R is first formed on the transparent electrodes 1R (FIG. 13), the green fluorescent material G is then formed on the transparent electrodes 1G, and the blue fluorescent material B is subsequently formed on the transparent electrodes 1B (FIG. 14).

Figure 15:
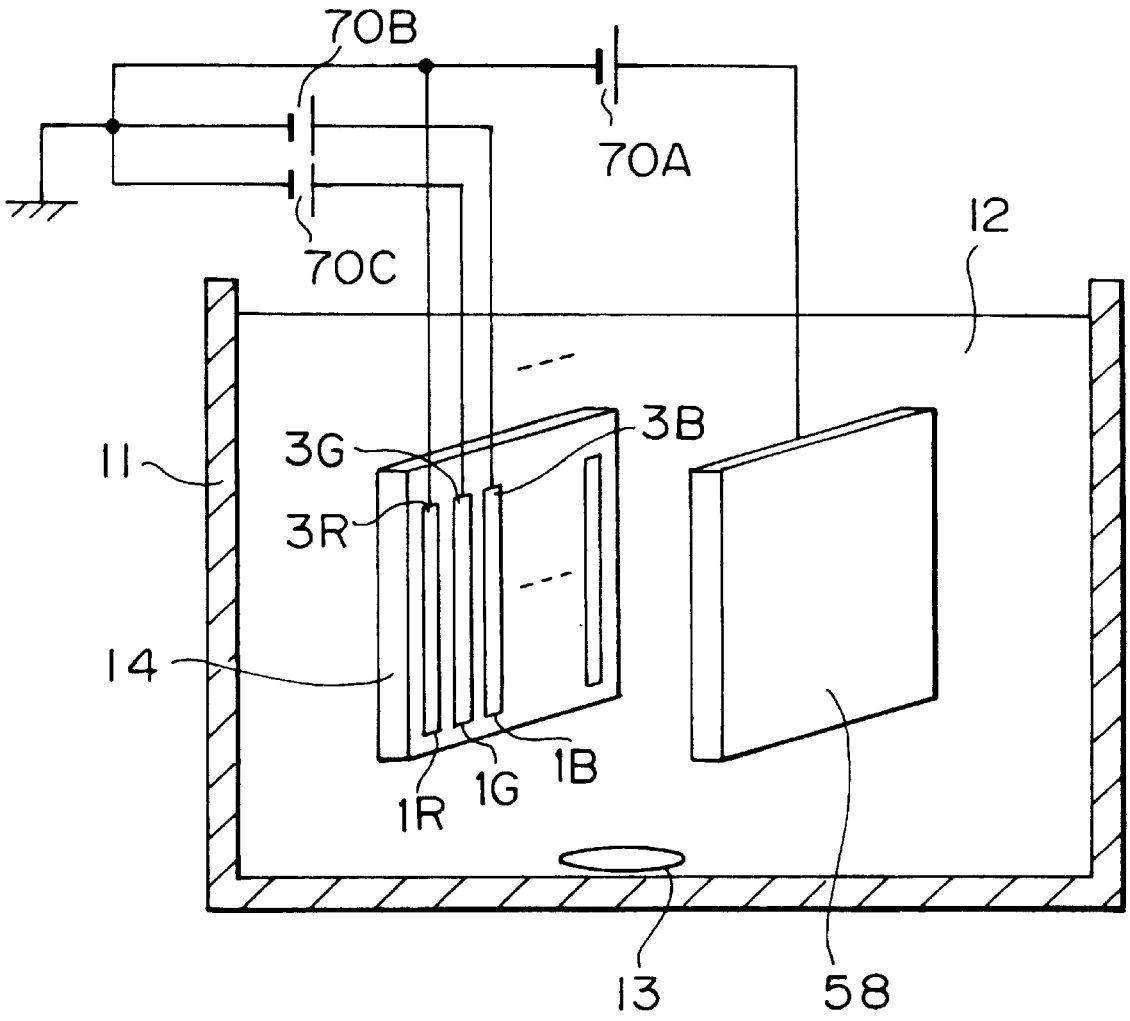
FIG. 15 is a schematic drawing showing a fluorescent material electrodeposition apparatus.

The panel 14 is first placed in an electrodeposition bath 11 in which a fluorescent powder having a required color is dispersed, as shown in FIG. 15, and red, green and blue fluorescent materials are successively electro-deposited on the stripe-formed transparent electrodes corresponding to the respective colors under uniform agitation by an agitator 13 or the like. Agitation may be performed by an agitating blade, pump circulation using a pump or the like other than the agitator 13.

Namely, the panel, for example, as shown in FIG. 12, is placed in the electrodeposition bath 11 containing an electrodeposition solution 12 in which a red fluorescent powder is dispersed. A voltage of 0 or a bias reverse to the electrodes (in this embodiment, the electrodes 1R) on which the red fluorescent material is deposited, is applied to the electrodes (in this embodiment, the electrodes 1G and 1B) on which the red fluorescent material is not deposited in the water-soluble or water-insoluble electro-deposition solution 12.

Such transparent electrodes 1R, 1G and 1B can be formed by the method of depositing the stripe-formed transparent electrodes 1R, 1G and 1B and then connecting the transparent electrodes corresponding to the same color. Namely, a transparent conductive layer of ITO is first deposited over the entire surface, and a photoresist is then coated over the entire surface, followed by exposure by a proximity exposure method, a contact exposure method or a stepper method using a pattern of stripe-formed chromium masks, development, etching and a resist stripping step to form the stripe-formed transparent electrodes 1R, 1G and 1B corresponding to, for example, red, green and blue, respectively.

Reference numerals 3R, 3G and 3B denote the terminals led out in correspondence with red, green and blue colors, respectively, and are formed by extending one of the transparent electrodes 1R, 1G and 1B for each of the colors, as compared with the other electrodes. In this embodiment, the terminals are led out at intervals of TRIO comprising red, green and blue. However, the lead-out positions are not limited to this, and the intervals can be changed to several intervals such as intervals of 2 TRIOs.

The fluorescent screen panel 14 having the transparent electrodes 1R, 1G and 1B formed thereon is placed in the electrodeposition bath 11 into which the electrodeposition solution 12 containing a fluorescent powder of a required color dispersed therein is poured, as shown in FIG. 15, so that the fluorescent material of this color is electro-deposited on the transparent electrodes 11 corresponding to the fluorescent power of this color. In this way, red, green and blue fluorescent materials are successively electro-deposited on the transparent electrodes 1R, 1G and 1B.

For example, $Y_2O_2S$:Eu, CdS and the like, ZnS:CU, Al and the like, ZnS:AG, Cl and the like, and ZnS:Mn, $Y_2O_3$:Eu, ZnO:Zn and the like can be used as red, green, blue and other color fluorescent materials, respectively. Almost all semiconductors and insulating materials, except powders which can easily be eluted by a solvent, can be used for electrodeposition. In FIG. 15, reference numeral 58 denotes a counter electrode having a polarity opposite to that of the electrodes 1R, 1G and 1B on the fluorescent screen panel in electrodeposition, reference numeral 70A denotes a power supply for electrodeposition, and reference numerals 70B and 70C each denote a power supply for applying a reverse bias.

In this construction, the panel 14 is first placed in the electrodeposition solution 12 containing the red fluorescent power dispersed therein. For example, in cathodic electrodeposition, the electrodeposition solution 12 contains, as an electrolyte, aluminum nitrate, magnesium nitrate, lanthanum nitrate, sodium hydroxide, potassium hydroxide, thorium nitrate or the like; glycerin as a dispersant; and isopropyl alcohol, acetone or the like as a solvent. A negative potential (DC voltage) is applied to the first stripe-formed transparent electrodes 1R through the terminals 3R, zero or positive potential (reverse bias voltage) is applied to the other stripe-formed transparent electrodes 1G and 1B through the terminals 3G and 3B, respectively. When a positive potential is applied to the counter electrode 58, the red fluorescent power is electro-deposited only on the electrodes 1R to form red fluorescent films (FIG. 13).

The panel 14 is then washed with an alcohol or the like for removing a small amount of fluorescent powder which adheres to spaces between the respective stripe-formed transparent electrodes 1R, 1G and 1B and the spacers 10 due to the non-electrostatic function such as Van der Waals force, and then dried by hot air.

The fluorescent screen panel 14 is then placed in the electrodeposition solution 12 containing a green fluorescent powder dispersed therein, a negative potential is applied to the transparent electrodes 1G corresponding to the green color through the terminals 3G, and zero or a positive potential (reverse bias voltage) is applied to the other transparent electrodes 1R and 1B. When a positive potential is applied to the counter electrode 58, the green fluorescent powder is electro-deposited only on the electrodes 1G to form green fluorescent films without color mixing with the red fluorescent films. In this case, the panel is washed with an alcohol and then dried with hot air in the same manner as described above.

The panel 14 is further placed in the electro-deposition solution 12 containing a blue fluorescent powder dispersed therein, a negative potential is applied to the transparent electrodes 1B corresponding to the blue color through the terminals 3B, and zero or a positive potential (reverse bias voltage) is applied to the other transparent electrodes 1R ad 1G. When a positive potential is further applied to the counter electrode 58, the blue fluorescent powder is electro-deposited only on the electrodes 1B to form blue fluorescent films without color mixing with the red fluorescent films and the green fluorescent films (FIG. 14). In this case, the panel 14 is washed with an alcohol or the like, and then dried with hot air in the same manner as described above.

The red, green and blue fluorescent materials R, G and B can be selectively coated on the narrow stripe-formed electrodes 1R, 1G and 1B, respectively, through the above-described steps.

In cathodic electrodeposition, hydrogen is generated on the cathode side due to electrolysis of water and electrochemical reaction of an electrolyte (free ion) on a cathode, and sometimes reduces the ITO films. However, this can be avoided by pre-treatment of the electrodeposition solution. For example, water is removed by removing $H_2$ by electrolytic treatment or the like, and electrolyte free ions such as $Al^{3+}$ and $La^{3+}$ are removed by changing the supernatant of the electrodeposition solution.

In the above process, the film values of each of the fluorescent materials can be controlled by the electrodeposition time, the strength of an electric field, the amount of the fluorescent material deposited, the agitation strength, etc. For example, a fluorescent material of 15 $\mu$m can be deposited on ITO stripes on an effective screen of a 48×48 mm square [a pitch 330 $\mu$m, a stripe width 200 to 300 nm, stripe space 50 $\mu$m, trio (red, green, blue) space 80 $\mu$m, stripe thickness 200 to 300 nm, 145 stripes per color, total 435 stripes] by electrodeposition for a time of 1 to 2 minutes with a DC voltage of 5 to 7.5 V.

The reason for setting the range of voltages is that when red, green and blue fluorescent materials are coated by electrodeposition, electrodes used as counter electrodes are different (the electrode spacing is also changed). When the red fluorescent material is coated on the central portion of the stripe-formed electrodes 1R, 1G and 1B for red, green and blue, respectively, by electrodeposition, since adjacent electrodes, i.e., the red and blue stripe-formed electrodes 1R and 1B serve as counter electrodes (the same electrode spacing), the same potential (about 7.5 V) may be applied to the electrodes.

For another color, electrodeposition can be precisely performed by controlling the potential in accordance with the electrode spacing (finely controlling to the optimum strength of the electric field). Since the range of potential differences to be applied to the counter electrode depends upon the electrode spacing, the range cannot readily be determined. However, the potential is not more than 500 V, preferably within the range of 1 to 50 V.

As described above, this embodiment employs the electrodeposition method for forming the fluorescent screen for FED in which a DC bias voltage is applied, under fine control, to portions of unselected electrodes (other electrodeposition electrodes set on the same plane or electrodes previously provided between the respective electrodeposition electrodes, which serve as counter electrodes) relative to the selected electrodes (electrodeposition stripe electrodes). This embodiment thus has the following significant effects:

(1) Electrodeposition coating can be performed on predetermined electrodes by using adjacent electrode patterns (or a single electrode pattern) serving as counter electrodes even if solid obstructions such as the spacers are present, thereby electro-depositing a fluorescent material which causes no loss of a degree of vacuum.

(2) It is possible to prevent occurrence of color mixture and adhesion of the fluorescent materials to portions between respective electrodeposition stripe electrodes even with a small width and a small pitch by applying a DC reverse bias voltage to electrodes other than the selected electrodes (at the same time, the voltage applied to the counter electrode required for electrodeposition is a reverse bias voltage).

(3) Since the electrodes are formed by lithography or printing method, the precision of the electrode spacing is significantly increased, and the electric field near the selected electrodes can be easily controlled by finely controlling the DC voltage, thereby permitting uniform coating of the fluorescent materials on the high-definition (narrow) stripes.

(4) Since the selected electrodes and counter electrodes can be provided on the same plane of the fluorescent screen panel, it is possible to realize decreases in the thicknesses of the electrodeposition bath and the electrodeposition apparatus, and a decrease in the amount of the electrodeposition solution. A decrease in the amount of the solution facilitates uniform agitation.

As described above, the provision of the three terminals 3R, 3G and 3B permits successive electrodeposition coating of R, G and B color materials, and color display of FED by time-series color selection. The three terminals are thus advantageous.

Figure 16A:
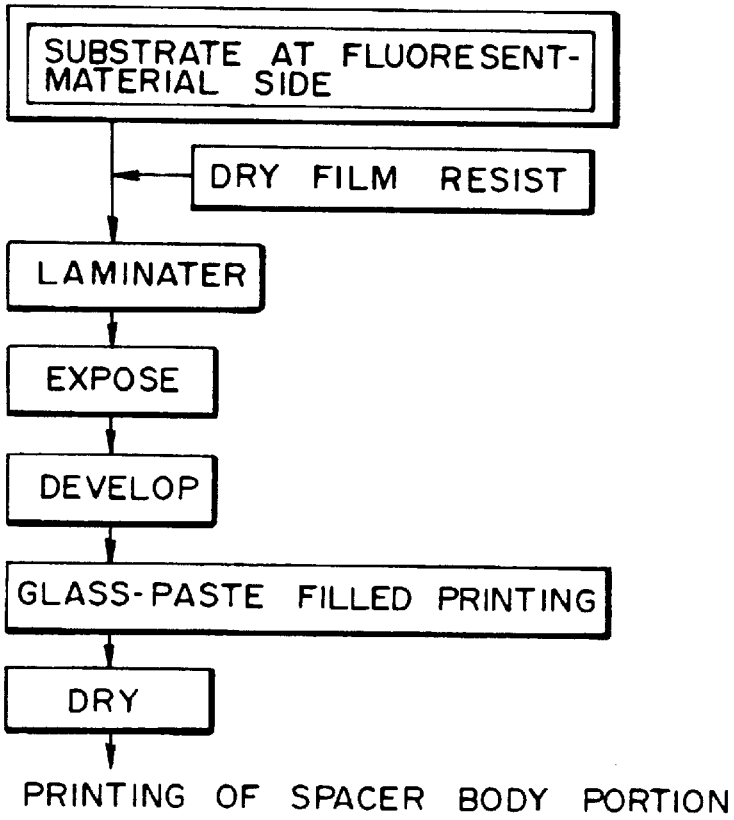
FIG. 16 is a flowchart showing the procedure for the process of producing the fluorescent screen panel.
Figure 16B:
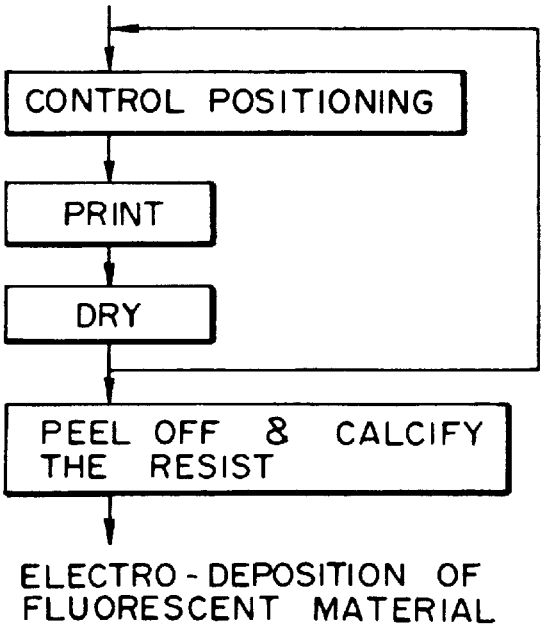

FIG. 16 is a flowchart showing the steps for forming the spacers. FIG. 16(A) shows the steps for forming the black mask layers, and FIG. 16(B) shows the steps for forming the spacer bodies.

The glass wall 29 is bonded to the entire side edge of the fluorescent screen panel 14 manufactured as described above (refer to FIG. 4), and the panel 14 is then joined to the back panel 16 separately manufactured to form the FED shown in FIG. 1.

Since the structure of the back panel 16 and the emission mechanism are the same as described above with reference to FIGS. 28 to 32, they are not described below.

Figure 17:
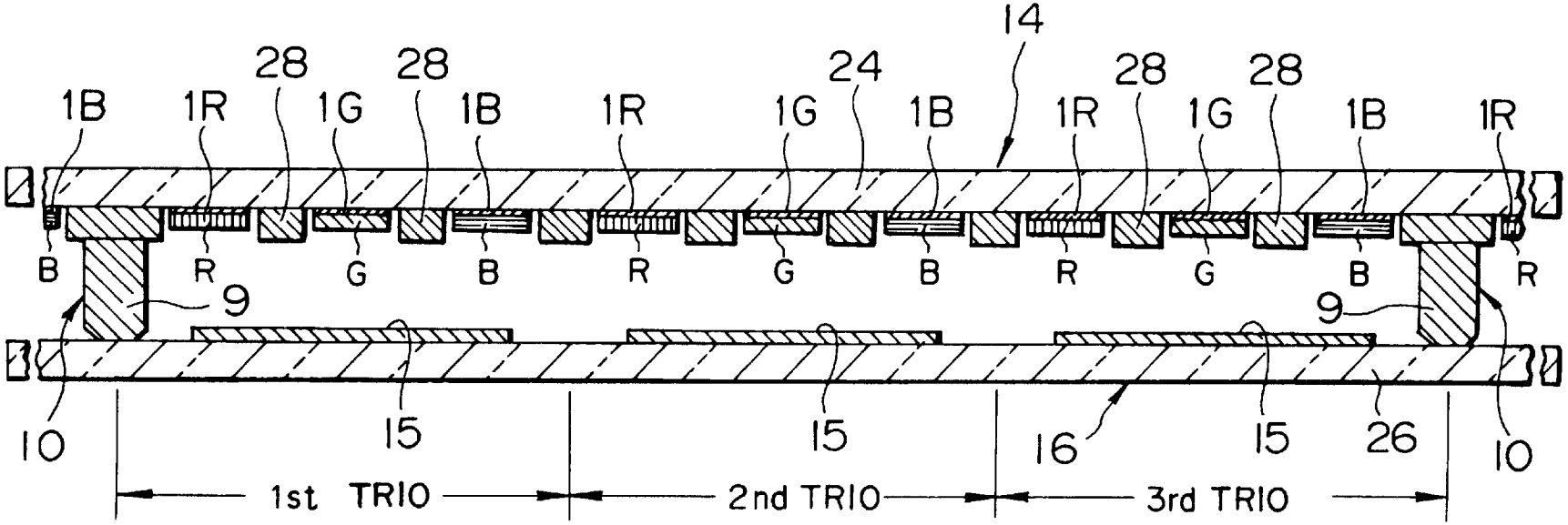
FIG. 17 is an enlarged sectional view showing a principal portion of FED in accordance with another embodiment of the invention similarly to FIG. 1.

The black mask layers and the spacer bodies can be formed by using different materials if the coefficients of thermal expansion thereof are the same. In this case, it is preferable to form the black mask layers by using a material having mechanical strength higher than that of the material used for forming the spacer bodies. However, the black mask layers 8 and the spacer bodies 9 are respectively integrated by burning to form the spacers. FIG. 17 is a sectional view of the FED manufactured as described above, similarly to FIG. 1.

The black mask layers 8 and 28 can be formed by methods other than the aforementioned method. Examples (first, second and fourth methods) of the methods are described below.

(Second Method)

Figure 18:
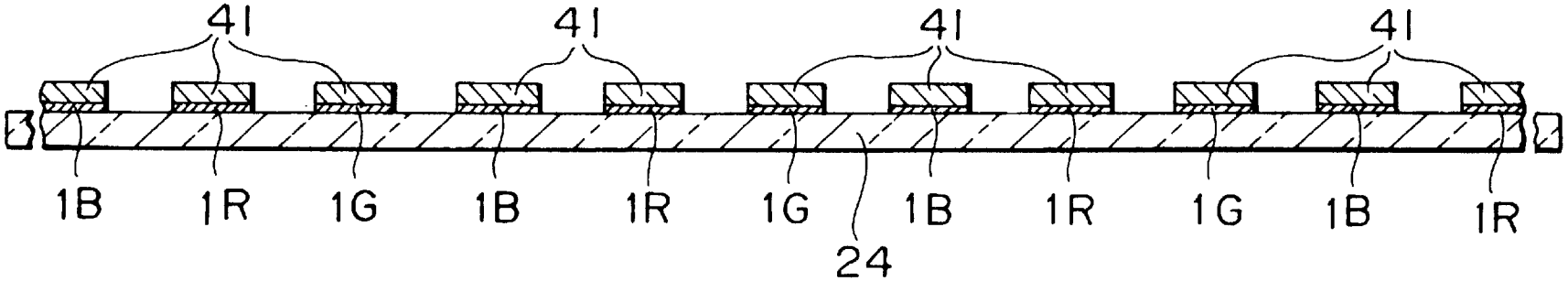
FIG. 18 is an enlarged partial sectional view of a substrate showing a first step for producing a fluorescent screen panel in accordance with a still another embodiment of the invention.
Figure 19:
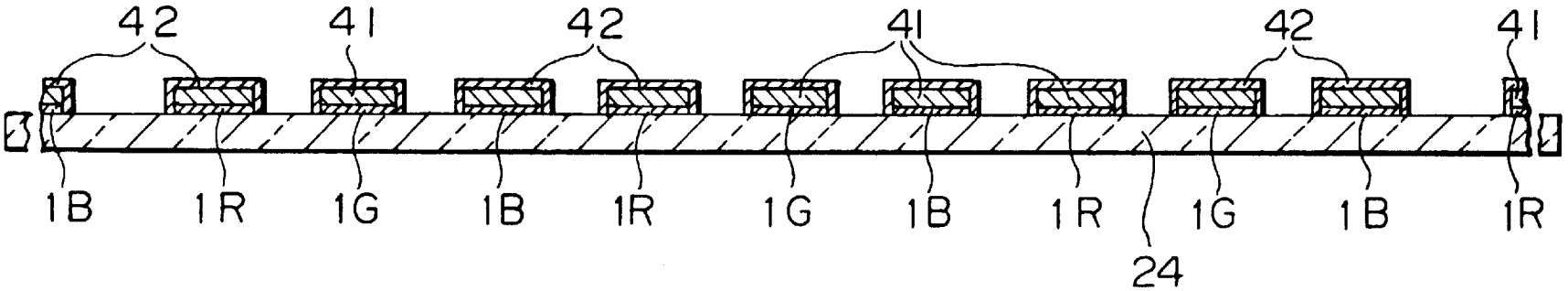
FIG. 19 is an enlarged partial sectional view of the substrate showing a second step for producing the same fluorescent screen panel.
Figure 20:
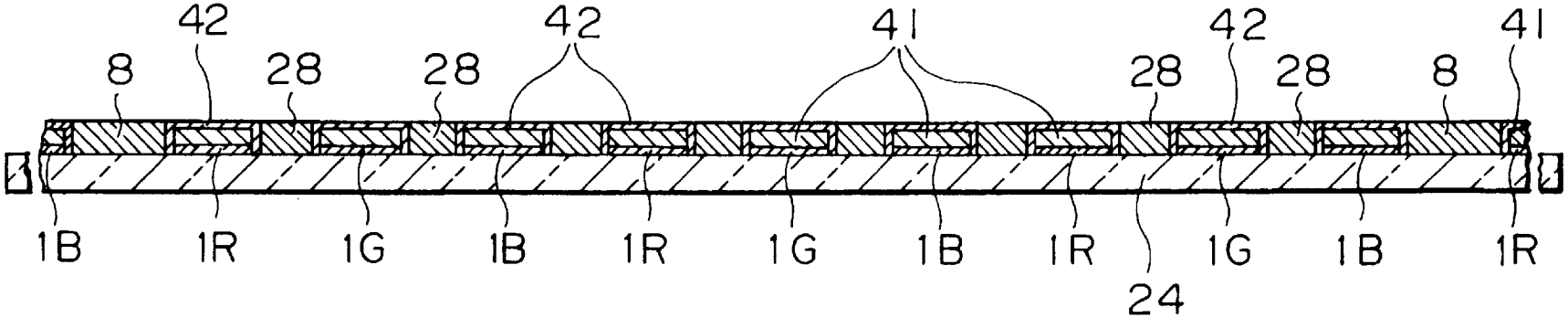
FIG. 20 is an enlarged partial sectional view of the substrate showing a third step for producing the same fluorescent screen panel.

As shown in FIG. 18, the first resist masks 41 used for patterning the transparent electrodes 1R, 1G and 1B are left, and second resist masks 42 are formed by conventional photolithographic technology so as to respectively cover the first resist masks 41, as shown in FIG. 19. The black mask layers 8 and 28 are then formed between the respective second resist masks 42 by the same method as described above, as shown in FIG. 20.

In this method, an exposure mask for patterning the second resist masks 42 can easily and precisely registered on the basis of the position of an exposure mask for patterning the first resist masks 41. The procedure for forming the spacers is the same as that in the above embodiment (this applies to the third and fourth methods).

(Third Method)

Figure 21:
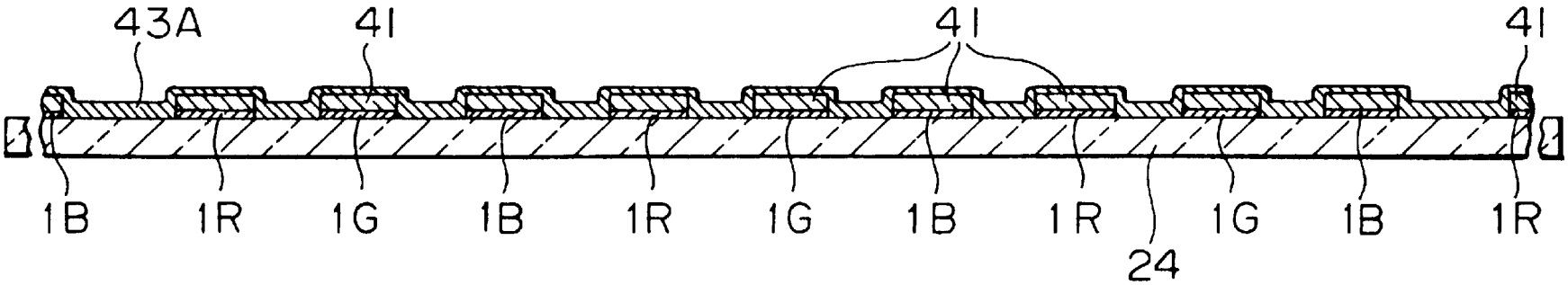
FIG. 21 is an enlarged partial sectional view of a substrate showing a first step for producing a fluorescent screen panel in accordance with a further embodiment of the invention.
Figure 22:
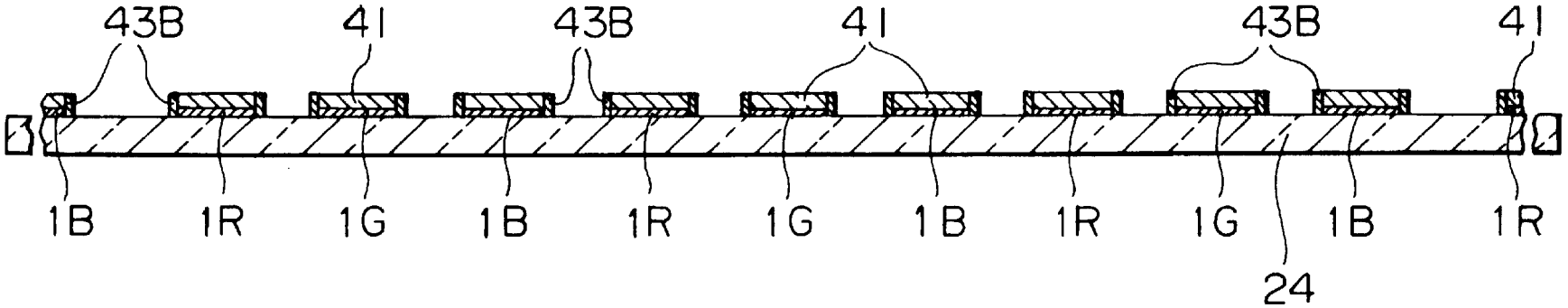
FIG. 22 is an enlarged partial sectional view of the substrate showing a second step for producing the same fluorescent screen panel.

A third photosensitive resist layer 43A is coated (or bonded) over the whole surface of the substrate in the state shown in FIG. 18, as shown in FIG. 21, and the whole surface is then etched. This whole surface etching leaves third narrow resist masks 43B on both sides of the transparent electrodes 1R, 1G and 1B and the first resist masks 41 formed thereon, and removes the other portions of the third resist layer, as shown in FIG. 22 (so-called side wall method).

Figure 23:
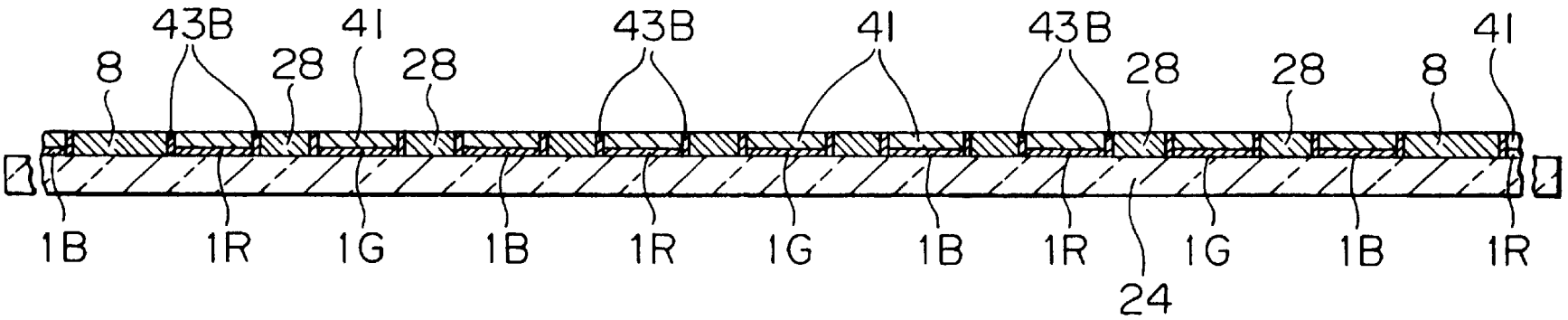
FIG. 23 is an enlarged partial sectional view of the substrate showing a third step for producing the same fluorescent screen panel.

The black mask layers 8 and 28 are then formed on portions between the respective third resist masks 43B, where the substrate is exposed, by the same method as that described above, as shown in FIG. 23. Since this method uses only an exposure mask for patterning the transparent electrodes as a pattering exposure mask, the method exhibits higher dimensional precision.

(Fourth Method)

Figure 24:
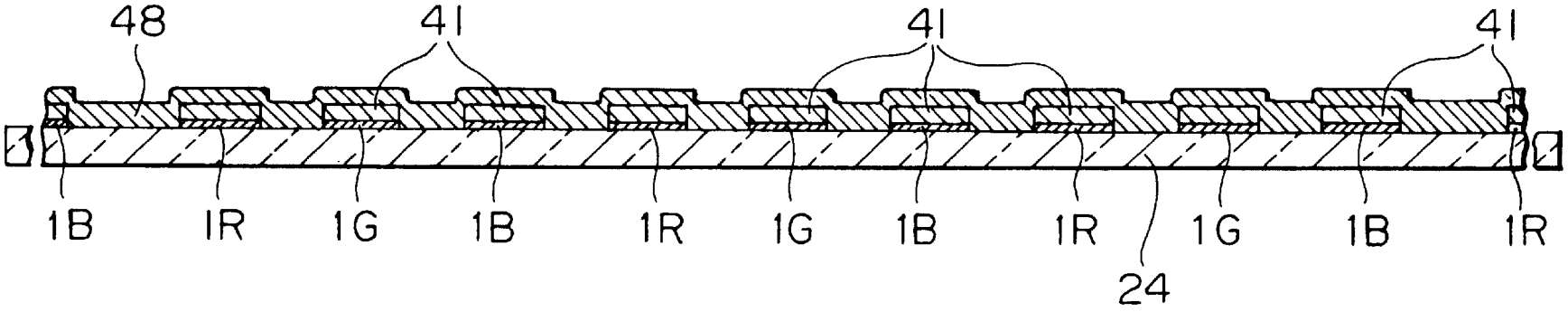
FIG. 24 is an enlarged partial sectional view of a substrate showing a first step for producing a fluorescent screen panel in accordance with a still further embodiment of the invention.
Figure 25:
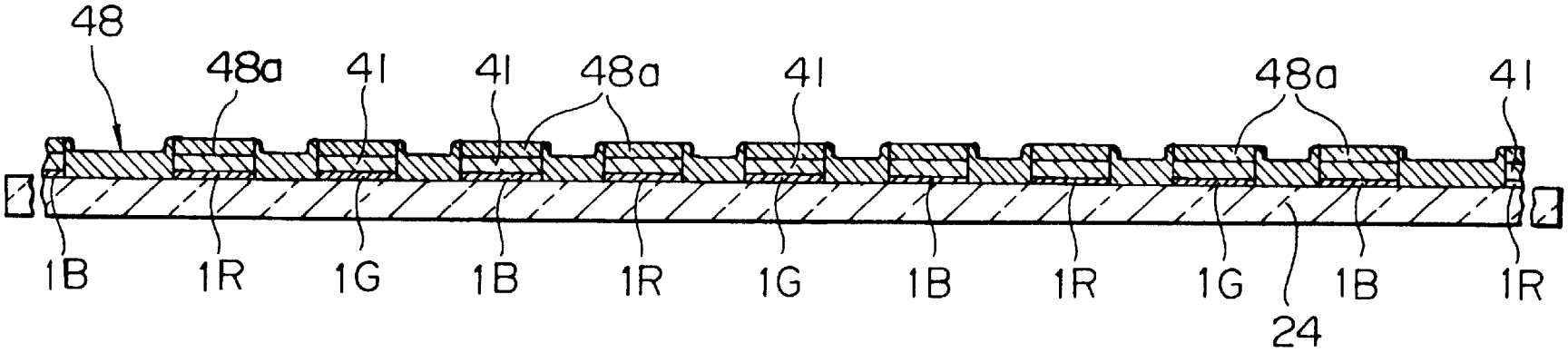
FIG. 25 is an enlarged partial sectional view of the substrate showing a second step for producing the same fluorescent screen panel.
Figure 26:
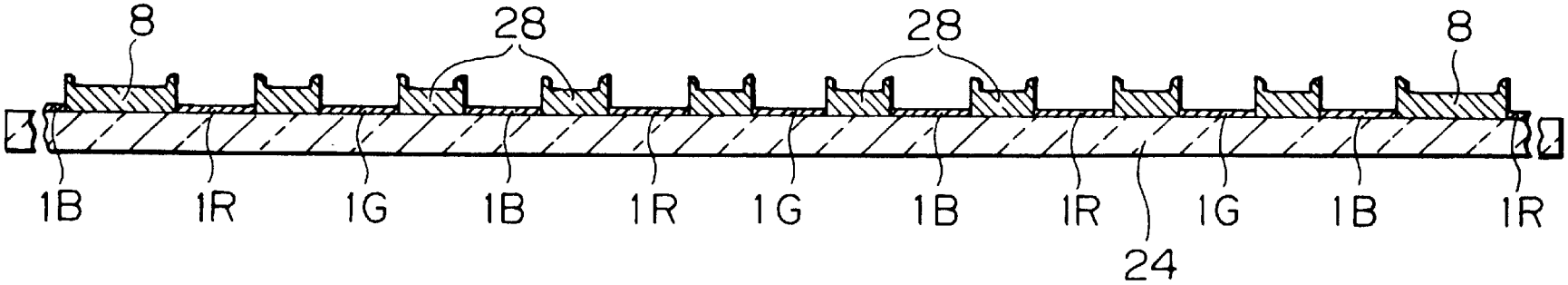
FIG. 26 is an enlarged partial sectional view of the substrate showing a third step for producing the same fluorescent screen panel.

A black mask material 48 is coated over the whole surface of the substrate in the state shown in FIG. 18, as shown in FIG. 24, and the first resist masks 41 are removed by resolution before drying. As a result, the black masks 48*a* formed on the first resist masks 41 are lifted off and removed together with the first resist masks 41, as shown in FIG. 25, to form the black masks layers 8 and 28 between the respective transparent electrodes 1R, 1G and 1B. This method forms no spaces between the transparent electrodes 1R, 1G and 1B and the black mask layers 8 and 28, and can thus decrease the pitch of the fluorescent material stripes. This is because the fluorescent material films are respectively formed on the transparent electrodes in the same pattern.

Figure 27:
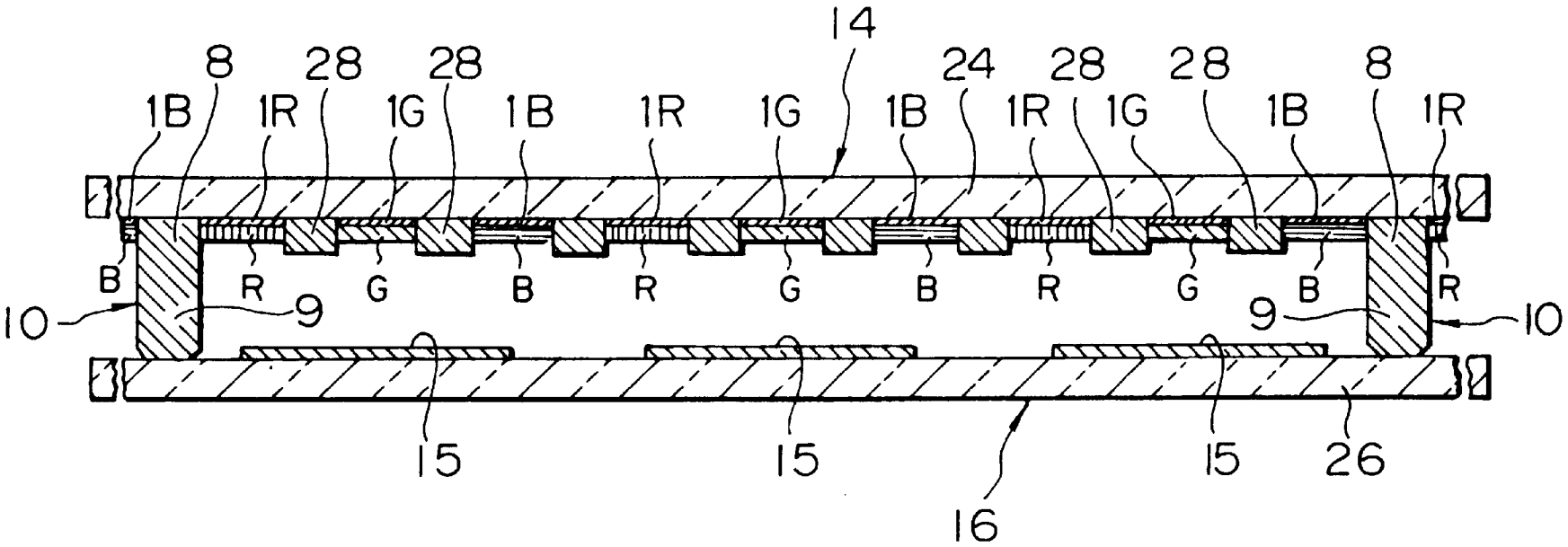
FIG. 27 is an enlarged sectional view of FED in accordance with a further embodiment of the invention similarly to FIG. 1.

Although, in each of the above embodiments, the black mask layers at the bottoms of the spacer bodies are wider than the other black mask layers, and the diameter of the spacer bodies is smaller than that of the lower black mask layers, the sizes of the spacer bodies and the black mask layers may be the same. FIG. 27 is a sectional view of FED similar to FIG. 1 where the sizes of the spacer bodies and the black mask layers are the same. When the width of the black mask layers 8 is the same as the black mask layers 28, the density per unit area of the fluorescent materials R, G and B can favorably slightly be increased.

Although the embodiments of the present invention are described above, the embodiments can further be modified on the basis of the technical idea of the present invention.

For example, the black mask layers may be formed by a method other than printing, and appropriate materials other than the above material may be used as the material for the black mask layers and the spacer bodies. Suitable materials other than the above materials may be used for the other components of FED.

The form of the spacer bodies is not limited to a cylindrical form, and the form may be an oval, a prism or the like. The spacer bodies may be provided in the form of a wall on the black mask layers.

The pattern and arrangement of the fluorescent materials and the transparent electrodes may be variously changed, and the black stripes may be replaced by a black matrix in which fluorescent materials and transparent electrodes are arranged in a lattice.

Further, the fluorescent materials can be replaced by other luminescent materials such as phosphorescent materials.

The light-emitting device of the present invention is not limited to FED or other display devices, the present invention can also be applied to an optical communication device in which an photoelectric conversion element is provided on the fluorescent screen panel of FED for converting an emission pattern of the fluorescent screen panel into an electrical signal.

The present invention comprises the mask layers which are respectively provided on non-emission portions without luminescent materials without overlapping the electrodes respectively formed at the bottoms of the luminescent materials, and thus exhibits the following effects.

Since the mask layers are present on the non-emission portions, light is satisfactorily emitted from the emission portions without being affected by other light. Particularly, when light is simultaneously emitted from a plurality of emission portions, good contrast is obtained.

Since the mask layers are provided so as not to overlap the electrodes, the luminescent materials on the electrodes do not overlap the mask layers, and the luminescent materials on the mask layers do not peel, thereby causing no trouble. It is thus possible to ensure good light emission.

Further, since the luminescent materials can be formed on the electrodes in the same pattern, the pitch of the electrodes and the luminescent materials provided thereon can be decreased because the mask layers do not overlap the electrodes, thereby achieving emission with high resolution.

What is claimed is:

1. A light emitting device comprising:

a first substrate provided with a plurality of luminescent material regions formed thereon;

a second substrate; and spacers for holding said first and second substrates opposite to each other at a predetermined space therebetween;

wherein said spacers are respectively formed on mask regions formed between said luminescent material regions and each of said spacers comprises a mask layer and a single spacer body formed thereon and further wherein the mask layers are formed between each of the plurality of said luminescent material regions and further wherein the spacers are formed between groups of three of said luminescent material regions.

2. A light emitting device according to claim 1, wherein said base layer is provided in an area larger than said single spacer body.

3. A light emitting device according to claim 1, wherein said base layer and said single spacer body are provided in separate steps.

4. A light emitting device according to claim 1, wherein said base layer and said single spacer body consist of the same material.

5. A light emitting device according to claim 1, wherein said base layer and said single spacer body consist of different materials.

6. A light emitting device according to claim 1, wherein said base layer and said spacer are integrated by burning.

7. A light emitting device according to claim 1, wherein said base layer is formed by printing, and said single spacer body is formed by lamination printing.

8. A light emitting device according to claim 1, wherein a plurality of said luminescent materials are provided in stripes, and said base layers are provided in stripes between said respective luminescent materials.

9. A light emitting device according to claim 1, wherein said luminescent materials are divided into groups each comprising luminescent materials of a plurality of colors, and said spacers are provided at intervals of a predetermined number of said luminescent material groups.

10. A light emitting device according to claim 1, wherein said first substrate consists of a transparent material, and said luminescent materials are provided on said first substrate through transparent electrodes.

11. A light emitting device according to claim 1, wherein said second substrate comprises a particle emission source so that light is emitted from said luminescent materials by the particles emitted from said particle emission source.

12. A light emitting device according to claim 11, wherein said particle emission source is a field emission cathode.

13. A light emitting device according to claim 1, wherein said luminescent materials are fluorescent materials.

14. A light emitting device according to claim 1, wherein each of said base layers comprises a black mask which is formed by using black glass paste.

15. A light emitting device comprising:

electrodes on a substrate;

a plurality of distinct luminescent material regions respectively provided on said electrodes;

mask layers for masking non-emission portions without said luminescent materials formed between each of said plurality of distinct luminescent material regions;

a second substrate;

spacers for holding said first and second substrates opposite to each other said spacers comprised of single spacer bodies respectively formed on selected mask layers selected from a plurality of said mask layers;

wherein each of said spacers comprises the selected mask layer and said single spacer body.

16. A display device comprising: mask regions formed on a fluorescent screen panel adjacent each of a plurality of distinct Red, Green and Blue emission regions wherein spacer bodies are formed on mask regions located at an outer edge of groups of distinct Red, Green and Blue emission regions.

17. The display device of claim 16, wherein each group of three sets of distinct Red, Green and Blue emission regions has a spacer body formed at each mask region located at each side edge thereof.

18. The display device of claim 16, wherein each of the spacer bodies are comprised of single spacer bodies.

19. The display device of claim 16, wherein the mask regions having spacer bodies formed thereon are wider than other mask regions.

* * * * *